US007561836B2

(12) United States Patent
Takagi

(10) Patent No.: US 7,561,836 B2
(45) Date of Patent: Jul. 14, 2009

(54) PROCESSING UNIT, TONER BOX AND IMAGE FORMING APPARATUS

(75) Inventor: Takeyuki Takagi, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 28 days.

(21) Appl. No.: 11/686,434

(22) Filed: Mar. 15, 2007

(65) Prior Publication Data

US 2007/0223971 A1 Sep. 27, 2007

(30) Foreign Application Priority Data

Mar. 27, 2006 (JP) ..... P2006-085924
Jan. 22, 2007 (JP) ..... P2007-011597

(51) Int. Cl.
*G03G 15/08* (2006.01)

(52) U.S. Cl. ..... 399/262

(58) Field of Classification Search ..... 399/119, 399/258, 262

See application file for complete search history.

(56) References Cited

U.S. PATENT DOCUMENTS 4,913,087 A 4/1990 Saita et al.
5,506,665 A 4/1996 Ishida et al.
5,568,237 A 10/1996 Ishida et al.
5,587,777 A 12/1996 Miyaji et al.
5,608,501 A * 3/1997 Makino ..... 399/119
5,614,996 A 3/1997 Tanda
5,659,837 A 8/1997 Jo
5,809,384 A * 9/1998 Johroku et al. ..... 399/262
6,856,779 B2 2/2005 Ota et al.
7,242,893 B2 * 7/2007 Murakami et al. ..... 399/262
7,266,330 B2 * 9/2007 Murakami et al. ..... 399/262
7,437,095 B2 10/2008 Shimomura et al.
2002/0181969 A1 12/2002 Terada et al.
2004/0047657 A1 3/2004 Nagashima et al.
2005/0135842 A1 6/2005 Murakami et al.
2005/0271425 A1 12/2005 Shimomura et al.

(Continued)

FOREIGN PATENT DOCUMENTS

CN 1627202 A 6/2005

(Continued)

OTHER PUBLICATIONS

Extended European Search Report dated Aug. 16, 2007 in Application No. 07006186.6.

(Continued)

*Primary Examiner*—Sandra L Brase
(74) *Attorney, Agent, or Firm*—Banner & Witcoff, Ltd.

(57) ABSTRACT

A processing unit including a unit main body and a toner box detachably mountable to the unit main body is described. The toner box may include a toner casing formed with a toner ejecting port for feeding the developing agent to the unit main body, and a toner-side blocking member for opening and closing the toner ejecting port. The unit main body includes a process casing formed with a toner guiding port to receive the developing agent fed from the toner ejecting port, a process-side blocking member for opening and closing the toner guiding port, and an open/close member for opening and closing the toner ejecting port and the toner guiding port by the toner-side blocking member and the process-side blocking member when the toner box is mounted to the unit main body.

34 Claims, 9 Drawing Sheets

U.S. PATENT DOCUMENTS

2007/0223971 A1 9/2007 Takagi

FOREIGN PATENT DOCUMENTS

| | | | |
|---|---|---|---|
| CN | 1222848 | C | 10/2005 |
| EP | 0 608 812 | A2 | 8/1994 |
| EP | 0 668 546 | A2 | 8/1995 |
| EP | 1 241 536 | A2 | 9/2002 |
| EP | 1 542 091 | A1 | 6/2005 |
| EP | 1 241 536 | A3 | 4/2006 |
| EP | 1 722 279 | A1 | 11/2006 |
| JP | 61022366 | | 1/1986 |
| JP | 61022367 | | 1/1986 |
| JP | 1021469 | | 1/1989 |
| JP | 3075769 | | 3/1991 |
| JP | 04-350870 | A | 4/1992 |
| JP | 4350870 | | 12/1992 |
| JP | 7049610 | | 2/1995 |
| JP | 7225514 | | 8/1995 |

OTHER PUBLICATIONS

Extended European Search Report dated Aug. 16, 2007 in Application No. 07004607.3.
Extended European Search Report dated Aug. 16, 2007 in Application No. 07006096.7.
Extended European Search Report dated Aug. 16, 2007 in Application No. 07006097.5.
CN Office Action dtd Oct. 10, 2008, CN Appln. 200710091677.0, English translation only.
U.S. Office Action dtd Nov. 17, 2008, U.S. Appl. No. 11/689,903.
CN Office Action dtd Sep. 5, 2008, CN Appln. 200710089700.2.
Final Office Action in corresponding U.S. Appl. No. 11/689,903, dated Apr. 28, 2009.
Notice of Allowance issued Apr. 8, 2009, in corresponding U.S. Appl. No. 11/689,798.

* cited by examiner

PROCESSING UNIT, TONER BOX AND IMAGE FORMING APPARATUS

CROSS REFERENCE TO RELATED APPLICATIONS

This application claims priority benefits on the basis of Japanese Patent Application No. 2006-85924 filed on Mar. 27, 2006 and Japanese Patent Application No. 2007-11597 filed on Jan. 22, 2007, the disclosures of which are incorporated herein by reference.

BACKGROUND OF THE INVENTION

1. Field

Aspects of the present invention relate to an image forming apparatus such as a laser printer and to a processing unit and a toner box which can be mounted to and removed from the image forming apparatus.

2. Description of the Related Art

In a developing unit in an image forming apparatus, the structure has been proposed to prevent undesired toner leakage, in which a toner box is removably mounted to the case of the developing unit, and the opening and closing operations of a first shutter which blocks a toner ejecting port of the toner box and a second shutter which blocks a toner guiding port of the stirring chamber in the developing apparatus, interlock.

In some developing units, the second shutter is mounted on an arm which is pivotably provided at a boss portion in the outer periphery of a supporting groove of a pair of right and left blankets of the casing of the developing unit, and the first shutter is provided on a lever which pivots about a spindle of the toner box. When the spindle of the toner box is inserted into and fixed to the supporting groove of the developing unit, and in this state, the lever of the toner box is pivoted, an engaging projection provided at the lever of the toner box allows the arm of the developing unit to pivot, and the first shutter and the second shutter to pivotably open and close with the first shutter and the second shutter overlapped with each other.

In such structure where the lever that pivots the first shutter is provided at the toner box, there is generally a fear that the toner inside the toner box may leak when the lever is inadvertently pivoted in the state where the toner box has been removed from the developing unit and the first shutter pivots to open the toner ejecting port. Alternatively, there is also a fear that the toner inside the stirring chamber may leak when the arm is inadvertently pivoted in the state where the toner box has been removed from the developing unit and the second shutter pivots to open the toner guiding port.

Therefore, in known the toner boxes, the first shutter is maintained by a first lock mechanism to block the toner ejecting port after the toner box is removed from the developing unit. At this time, the second shutter is maintained by a second lock mechanism to block the toner guiding port in the developing unit. Consequently, these first and second lock mechanisms prevent inadvertent rotation of the first shutter and the second shutter in the state where the toner box is removed from the developing unit, and thus prevent the leakage of the toner from the inside of the toner box and the inside of the stirring chamber of the developing unit.

However, the first lock mechanism and the second lock mechanism described above are each made of a lock body and a screw and are separate components from the first shutter and the second shutter. When these lock mechanisms are mounted to the first shutter and the second shutter, respectively, the first shutter and the second shutter are required to be formed with a pressing pin and a lock hole, resulting in a complicated structure of the toner box and the developing unit.

SUMMARY

One aspect of the present invention to provide a processing unit which may prevent the leakage of the developing agent with a simple structure, a toner box which is detachably mounted to the processing unit and can prevent the leakage of the developing agent with a simple structure, and an image forming apparatus to which these processing unit and toner box are detachably mountable.

The same or different aspect of the present invention may provide a processing unit detachably mountable to an image forming apparatus main body, including: a unit main body including at least a developer carrier for feeding a developing agent to an image carrier to be formed with an electrostatic latent image; and a toner box accommodating the developing agent and detachably mountable to the unit main body, wherein the toner box includes a toner casing formed with a toner ejecting port for feeding the developing agent to the unit main body, and a toner-side blocking member for opening and closing the toner ejecting port, and the unit main body includes a process casing formed with a toner guiding port which is opposed to the toner ejecting port to receive the developing agent fed from the toner ejecting port when the toner box is mounted in the unit main body, a process-side blocking member for opening and closing the toner guiding port, and an open/close member provided on the process casing for opening and closing the toner ejecting port and the toner guiding port by the toner-side blocking member and the process-side blocking member when the toner box is mounted in the unit main body.

One or more aspects of the present invention provide a processing unit detachably mountable to an image forming apparatus main body including a unit main body including at least a developer carrier for feeding a developing agent to an image carrier formed with an electrostatic latent image, and including a process casing, and a process-side blocking member for opening and closing by pivot a toner guiding port formed in the process casing for receiving the developing agent; and a toner box accommodating the developing agent therein and detachably mountable to the unit main body, wherein the toner box including an outer casing formed with a first toner ejecting port which is opposed to the toner guiding port when the toner box is mounted in the unit main body, and an inner casing pivotably provided with respect to the outer casing in the outer casing and formed with a second toner ejecting port, and the inner casing including a first projection engaged with an open/close member provided on the processing unit side in a state where the toner box is mounted in the unit main body, for communicating the first toner ejecting port and the second toner ejecting port with each other or for stopping the communication thereof by pivoting the inner casing in accordance with a movement of the open/close member, and a second projection interlocked with the first projection, for opening and closing the toner guiding port by pivoting the process-side blocking member in accordance with the movement of the open/close member.

Further, one or more aspects of the present invention provide a toner box accommodating a developer agent, and detachably mountable to a unit main body included in a processing unit detachably mountable to an image forming apparatus main body, wherein the unit main body includes at least a developer carrier for feeding a developing agent to an image carrier to be formed with an electrostatic latent image, and includes a process casing, and a process-side blocking member for opening and closing by pivot a toner guiding port formed in the process casing for receiving the developing agent; the toner box including: a toner casing formed with a toner ejecting port which is opposed to the toner guiding port for feeding the developing agent to the unit main body when the toner box is mounted in the unit main body; a toner-side blocking member for opening and closing the toner ejecting port by pivot; a first projection engaged with an open/close member provided on the processing unit side when the toner box is in a state of being mounted in the unit main body, for opening and closing the toner ejecting port by pivoting the toner-side blocking member in accordance with a movement of the open/close member; and a second projection interlocked with the first projection, for opening and closing the toner guiding port by pivoting the process-side blocking member in accordance with the movement of the open/close member.

Further, one or more aspects of the present invention provide a toner box accommodating a developer agent and detachably mountable to a unit main body included in a processing unit detachably mountable to an image forming apparatus main body, wherein the unit main body includes at least a developer carrier for feeding a developing agent to an image carrier to be formed with an electrostatic latent image, and includes a process casing, and a process-side blocking member for opening and closing by pivot a toner guiding port formed in the process casing for receiving the developing agent; the toner box including: an outer casing formed with a first toner ejecting port which is opposed to the toner guiding port when the toner box is mounted in the unit main body; and an inner casing pivotably provided with respect to the outer casing in the outer casing and formed with a second toner ejecting port, wherein the inner casing including a first projection engaged with an open/close member provided on the processing unit side in a state where the toner box is mounted in the unit main body, for communicating the first toner ejecting port and the second toner ejecting port with each other or for stopping the communication thereof by pivoting the inner casing in accordance with a movement of the open/close member, and a second projection interlocked with the first projection, for opening and closing the toner guiding port by pivoting the process-side blocking member in accordance with the movement of the open/close member.

Further, one or more aspects of the present invention provide a toner box including an outer casing and an inner casing accommodated in the outer casing and freely pivotable with respect to the outer casing, and accommodating a developing agent, wherein the outer casing includes an outer round wall forming a hollow cylinder and formed with a first toner ejecting port, and a pair of outer side edge walls forming both side end surfaces of the outer round wall in a direction of a pivot axis of the inner casing, the inner casing is formed in a hollow cylinder and includes an inner round wall formed with a second toner ejecting port which communicates with the first toner ejecting port in accordance with a pivot of the inner casing, and a pair of inner side edge walls for blocking both side surfaces in a direction of a pivot axis of the inner round wall, the respective both end portions of the inner round wall in the direction of the pivot axis are provided with a pair of second radial projections and a pair of third radial projections which protrude outward in radial directions of the inner casing, each of the both end portions of the outer round wall in a direction of the pivot axis are formed with a first insertion groove allowing the second radial projection to protrude outward in the radial direction and a second insertion groove allowing the third radial projection to protrude outward in the radial direction, and the second toner ejecting port is formed between a line connecting the pair of second radial projections and a line connecting the pair of third radial projections.

Further, one or more aspects of the present invention provide an image forming apparatus, including: an image forming apparatus main body; and a processing unit detachably mountable to the image forming apparatus main body, wherein the processing unit includes a unit main body including at least a developer carrier for feeding a developing agent to an image carrier to be formed with an electrostatic latent image, and a toner box accommodating the developing agent and being detachably mountable to the unit main body, the toner box includes a toner casing formed with a toner ejecting port for feeding the developing agent to the unit main body, and a toner-side blocking member for opening and closing the toner ejecting port, and the unit main body includes a process casing formed with a toner guiding port which is opposed to the toner ejecting port and receives the developing agent fed from the toner ejecting port when the toner box is mounted in the unit main body, a process-side blocking member for opening and closing the toner guiding port, and an open/close member provided at the process casing and opening and closing the toner ejecting port and the toner guiding port by the toner-side blocking member and the process-side blocking member when the toner box is mounted in the unit main body, the image forming apparatus including: a scanning section for forming the electrostatic latent image in the processing unit; and a fixing unit for fixing on recording medium a developer image formed by developing the electrostatic latent image in the processing unit.

DETAILED DESCRIPTION OF THE EMBODIMENTS

Details of embodiments of one or more aspects of the present invention will be described hereinafter with reference to the drawings.

First Embodiment

1. Overall Configuration of Laser Printer

Figure 1:
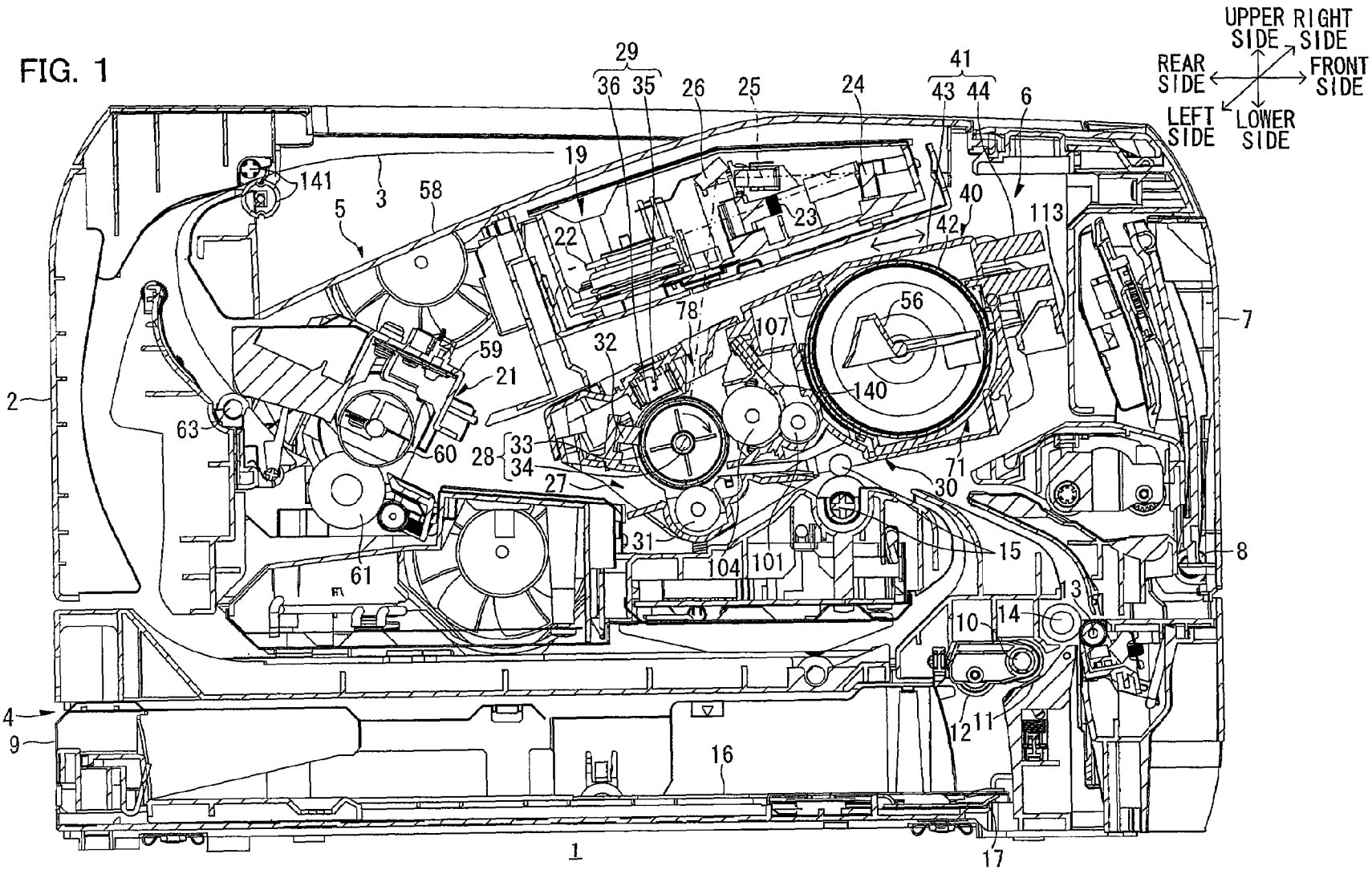
FIG. 1 is a sectional side view showing an embodiment of a laser printer as an image forming apparatus of one or more aspects of the present invention.

FIG. 1 is a sectional side view showing an embodiment of a laser printer as an image forming apparatus of one or more aspects of the present invention.

The laser printer 1 includes a main body casing 2 as an image forming apparatus main body, a sheet feeding section 4 accommodated in the main body casing 2 for feeding a sheet 3, and an image forming section 5 for forming an image on the fed sheet 3, as shown in FIG. 1.

(1) Main Body Casing

On one side wall of the main body casing 2, a mounting port 6 is formed for mounting a processing unit 20 which will be described later, and a front cover 7 is provided for opening and closing the mounting port 6. The front cover 7 is rotatably supported by a cover shaft 8 which is inserted through the lower end portion thereof. Accordingly, when the front cover 7 is opened with the cover shaft 8 as a supporting point, the mounting port 6 is opened and the processing unit 20 can be mounted and removed via the mounting port 6 to and from the main body casing 2, while the front cover 7 is closed with the cover shaft 8 as a supporting point, the front cover 7 closes the mounting port 6.

In the following description, the side on which the front cover 7 is provided in a state where the processing unit 20 is mounted in the main body casing 2 will be described as a "front side" (front surface side), and the opposing side thereof will be described as a "rear side" (back surface side). The sheet thickness direction toward the near side in FIG. 1 will be described as a "left side" and the sheet thickness direction toward the far side in FIG. 1 will be described as a "right side". In some cases, the left and right direction may be referred to as a "width direction".

(2) Sheet Feeding Section

The sheet feeding section 4 is provided on the bottom in the main body casing 2 and includes a sheet feeding tray 9, a separation roller 10, a separation pad 11, a sheet feeding roller 12, a sheet dust removing roller 13, a pinch roller 14, and a resist roller 15.

The sheet feeding tray 9 includes a sheet pressing plate 16 therein and a lever 17 in the front end portion thereof. The lever 17 lifts up the front end portion of the sheet pressing plate 16.

The sheets 3, which are placed on the sheet pressing plate 16, are transported to a separation position between the separation roller 10 and the separation pad 11 by the rotation of the sheet feeding roller 12 and separated one by one at the separation position, and then each sheet 3 passes a space between the sheet dust removing roller 13 and the pinch roller 14, and is transported toward the resist roller 15.

The sheet 3 transported to the resist roller 15 is then transported to a transfer position between a transfer roller 31 and a photosensitive drum 28 which will be described later and serves as an image carrier.

(3) Image Forming Section

The image forming section 5 includes a scanning section 19, a processing unit 20 and a fixing section 21 as a fixing unit.

(a) Scanning Section

The scanning section 19 is provided at an upper portion in the main body casing 2, and includes a laser beam source (not shown), a rotatably driven polygonal mirror 22, an fθ lens 23, a reflecting mirror 24, a lens 25 and a reflecting mirror 26. The laser beam source emits laser beams based upon image data. The beams are deflected at the polygonal mirror 22 and pass the fθ lens 23, as indicated by a chain line. The beam passage is then reflected by the reflecting mirror 24, the beams pass the lens 25, and further reflected downward by the reflecting mirror 26 to be irradiated on the surface of the photosensitive drum 28 in the processing unit 20.

(b) Processing Unit

Figure 2:
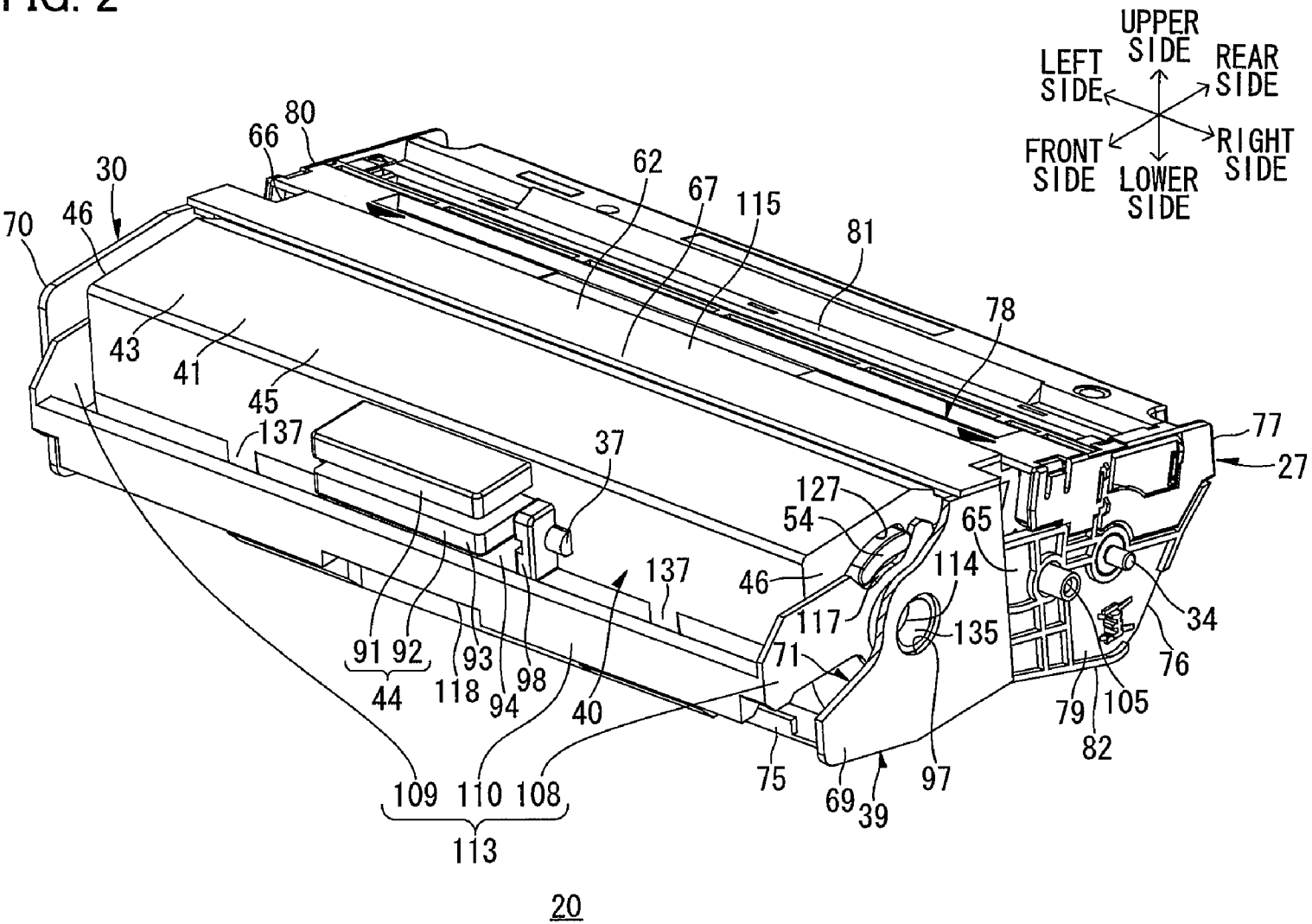
FIG. 2 is a right perspective view of a processing unit in a laser printer shown in FIG. 1 as viewed from above the front side.
Figure 3:
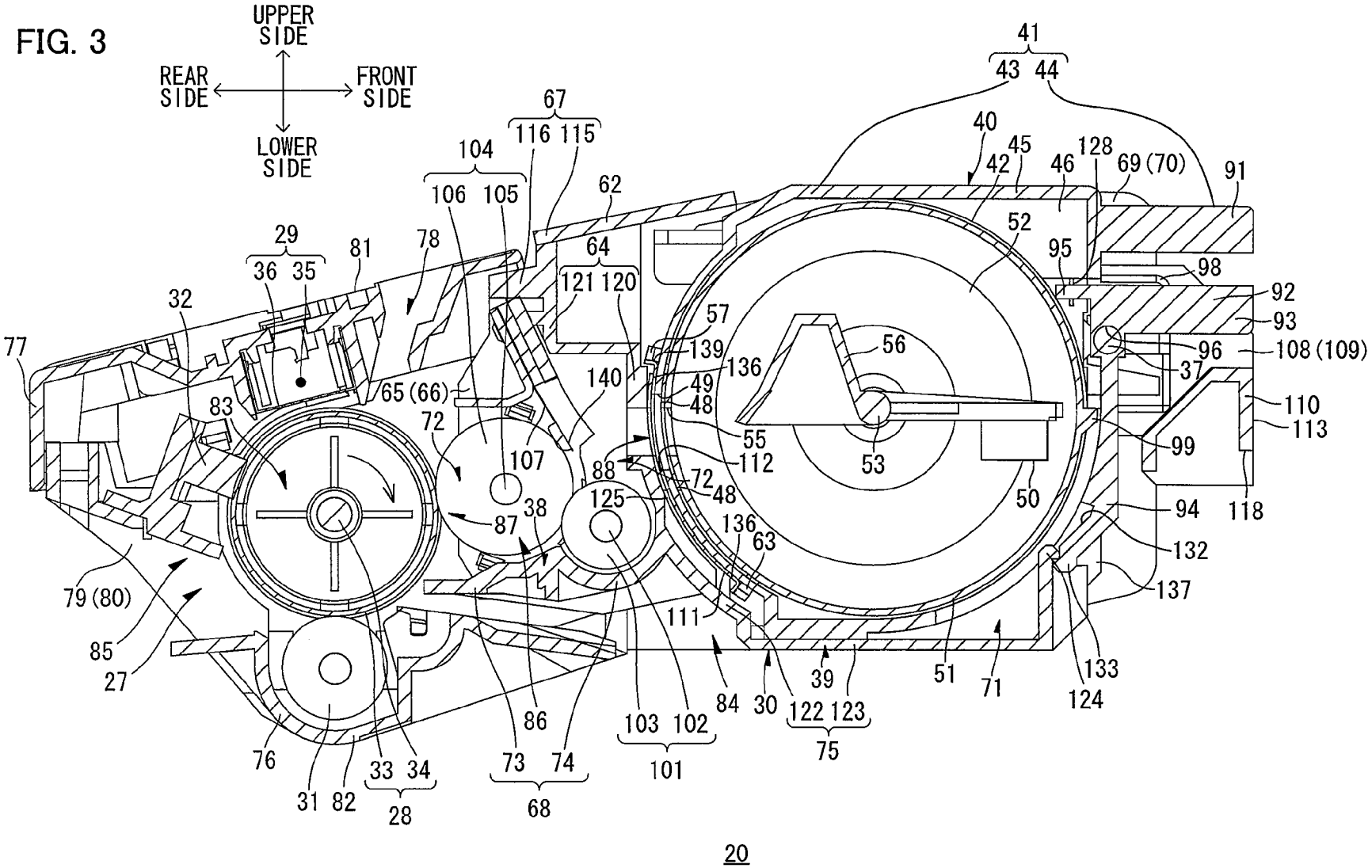
FIG. 3 is a left sectional side view of a processing unit in FIG. 2.

FIG. 2 is a right perspective view of a processing unit in the laser printer shown in FIG. 1 as viewed from above the front side, and FIG. 3 is a left sectional side view of the processing unit in FIG. 2.

Figure 4:
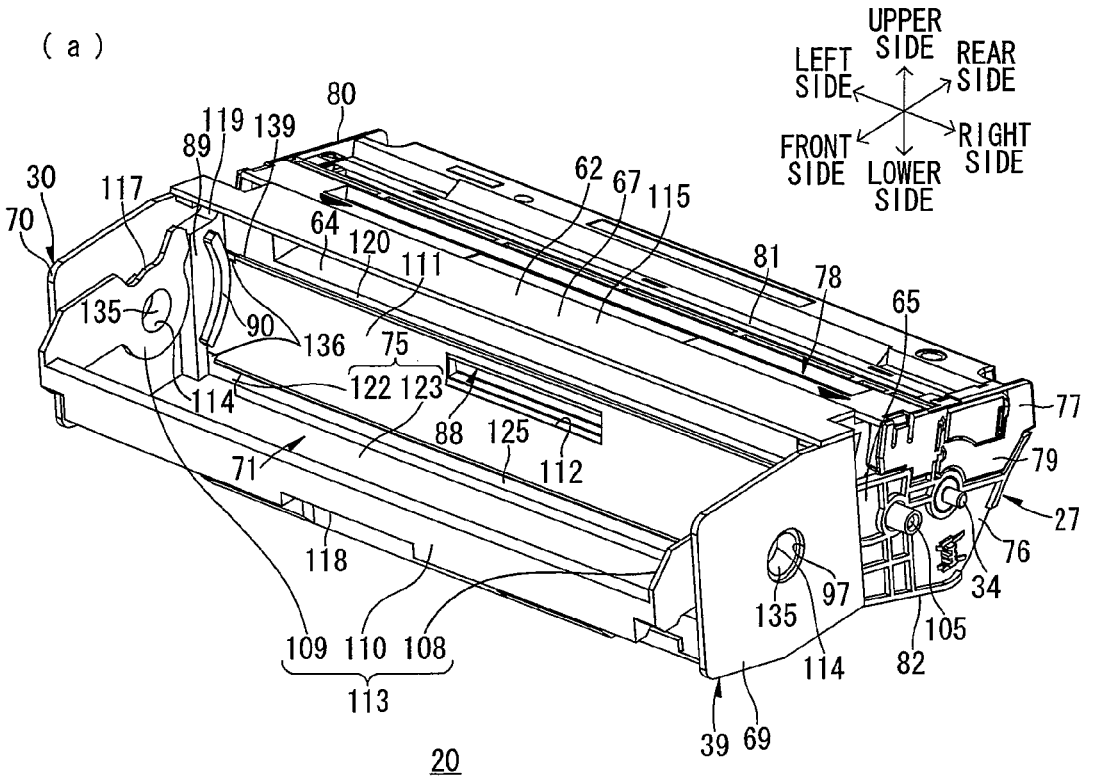
FIGS. 4(*a*) and 4(*b*) show aspects where a toner box has been removed in FIG. 2, and FIG. 4(*a*) shows an open lever being at a lever opening position to open a toner guiding port, and FIG. 4(*b*) shows the open lever being at a lever closing position to close a toner guiding port.
Figure 4:
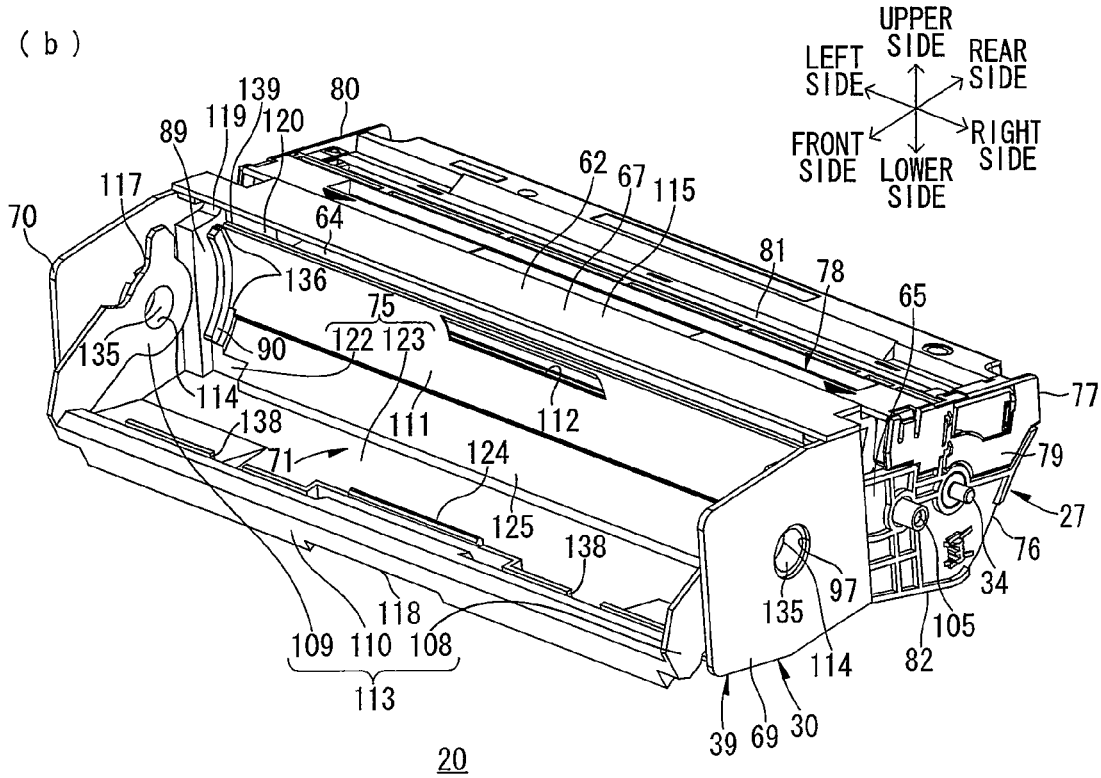

FIG. 4(*a*) shows an aspect in which a toner box is removed, an open lever is at a lever opening position and a toner guiding port is opened, and FIG. 4(*b*) shows an aspect in which the open lever is at a lever closing position and the toner guiding port is closed.

Figure 5:
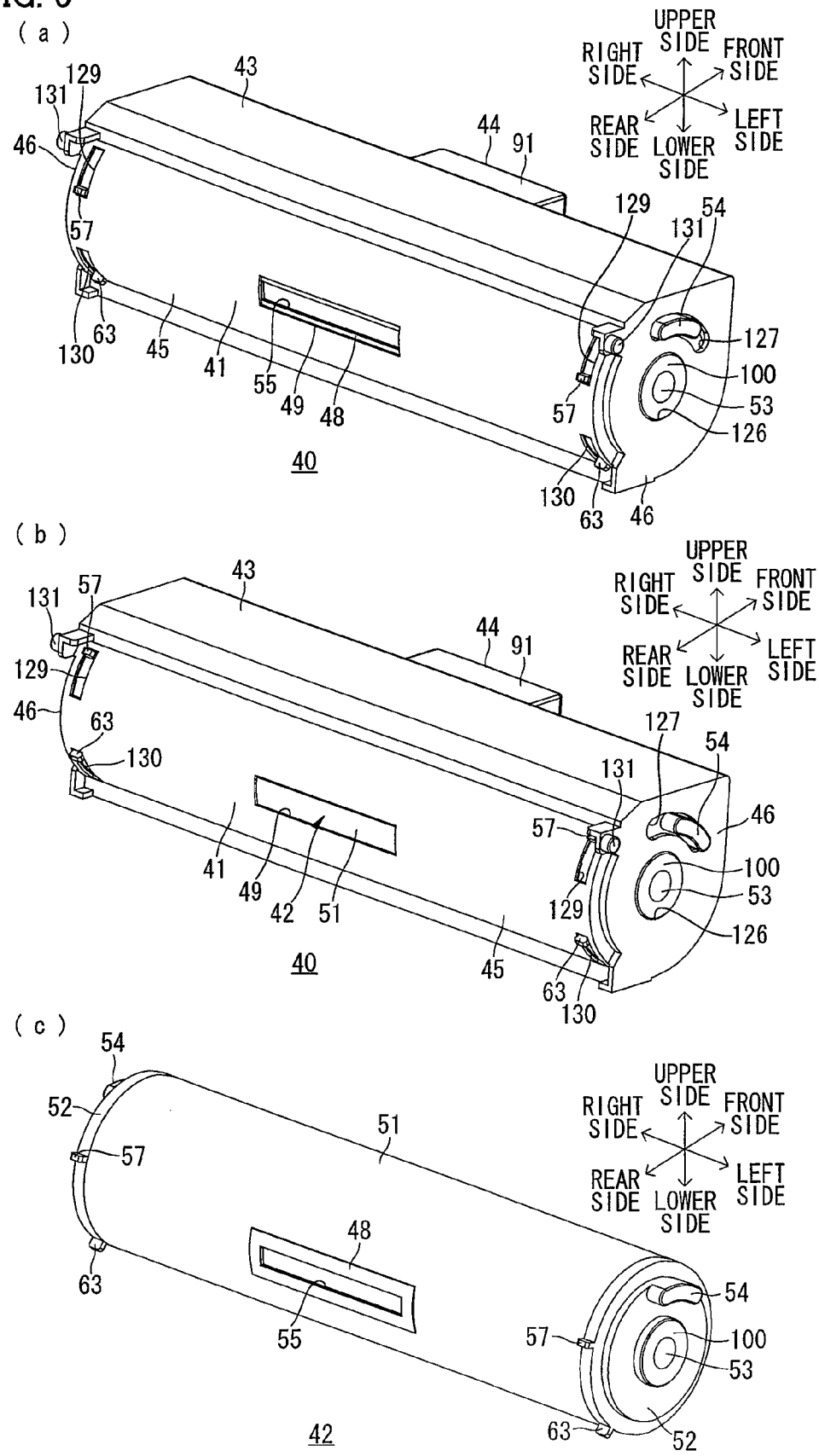
FIGS. 5(*a*), 5(*b*), and 5(*c*) are left perspective views of a toner box in the processing unit shown in FIG. 2 as viewed from above the rear side, FIG. 5(*a*) shows an aspect where a toner ejecting port is opened, FIG. 5(*b*) shows an aspect where the toner ejecting port is closed, and FIG. 5(*c*) shows an inner casing in the toner box.

FIG. 5(*a*) is a left perspective view of a toner box in the processing unit shown in FIG. 2 as viewed from above the rear side, and shows an aspect where a toner ejecting port is opened; FIG. 5(*b*) shows an aspect where the toner ejecting port is closed; and FIG. 5(*c*) is a left perspective view of an inner casing in the toner box shown in FIG. 5(*a*) as viewed from above the rear side.

Figure 6:
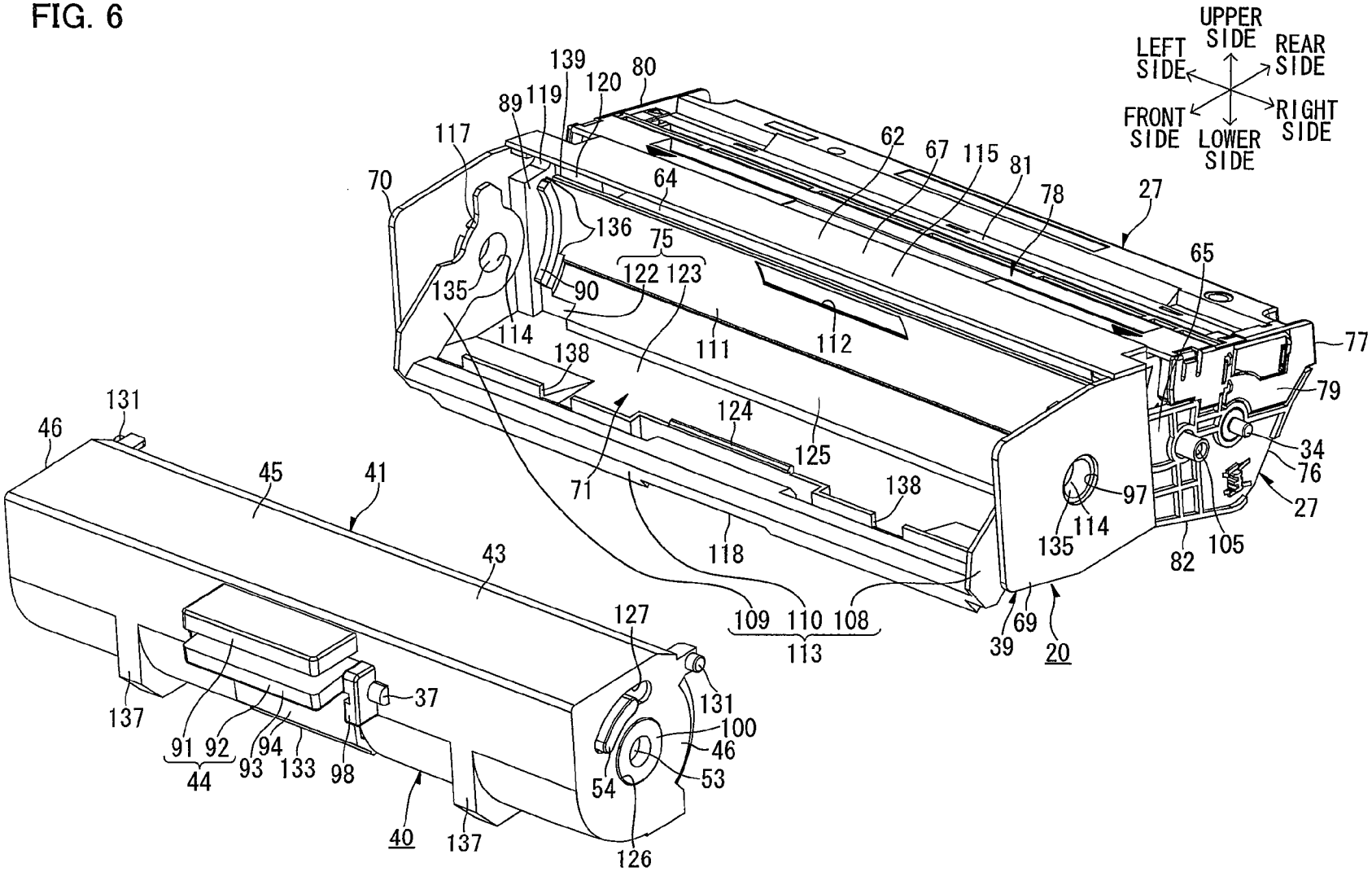
FIG. 6 shows an aspect where the toner box has been removed and the open lever is at the lever closing position in FIG. 2, together with the toner box removed therefrom.
Figure 7:
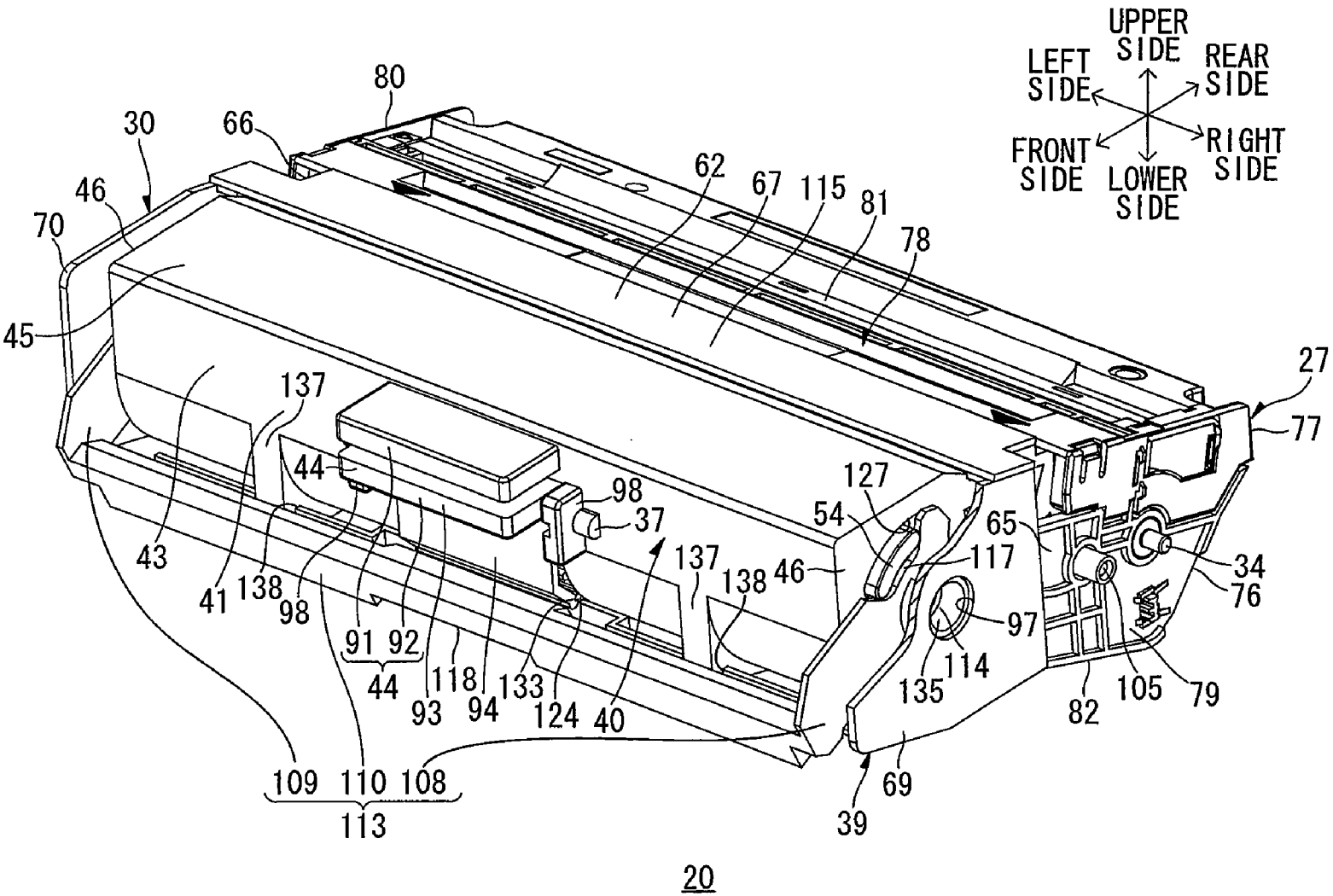
FIG. 7 shows an aspect where the open lever is at the lever closing position in FIG. 2.

FIG. 6 shows an aspect in which the toner box is removed and the open lever is at the lever closing position in FIG. 2, together with the toner box removed therefrom, while FIG. 7 shows an aspect in which the open lever is at the lever closing position in FIG. 2.

Figure 8:
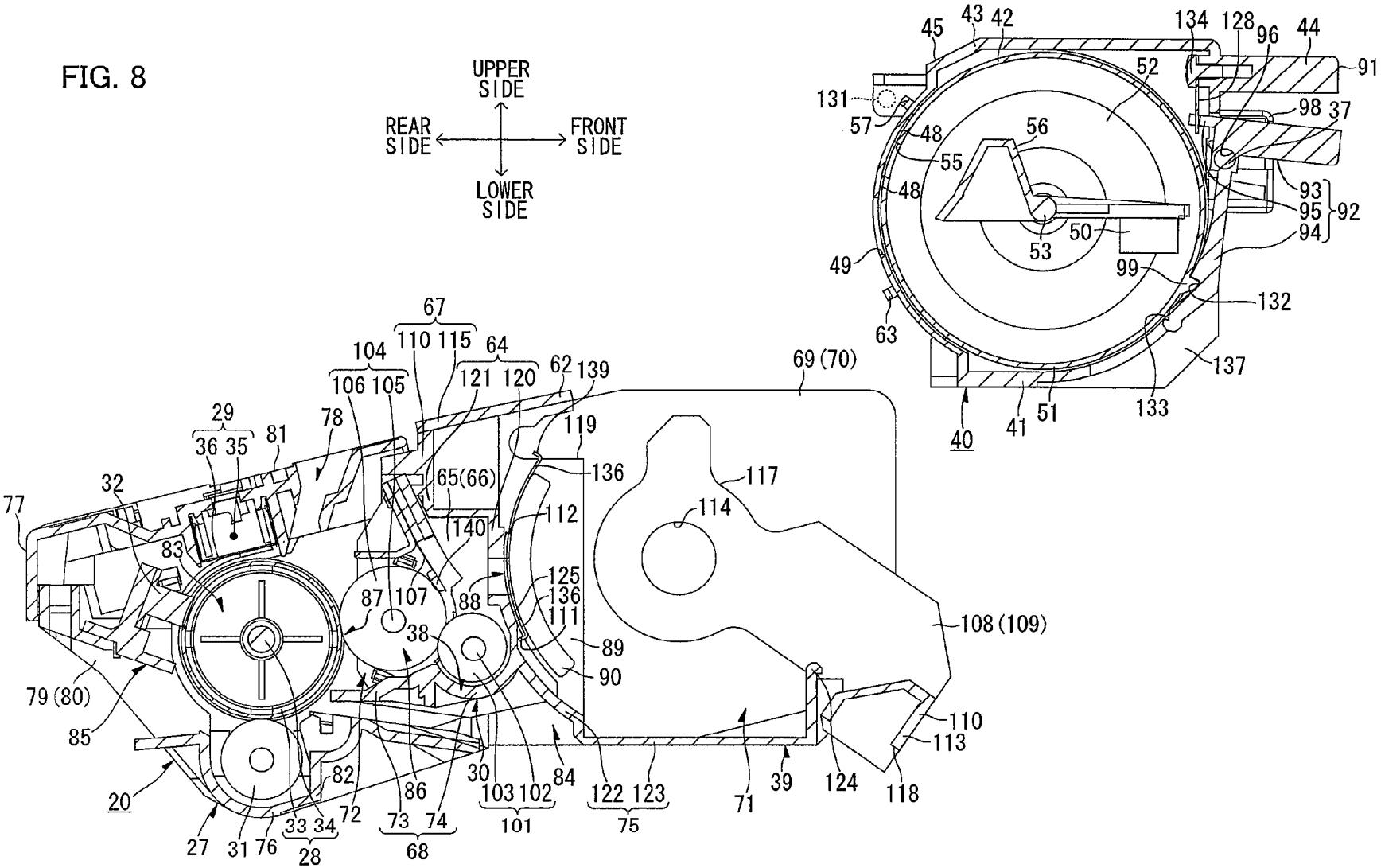
FIG. 8 is a left sectional side view of the processing unit in FIG. 6.
Figure 9:
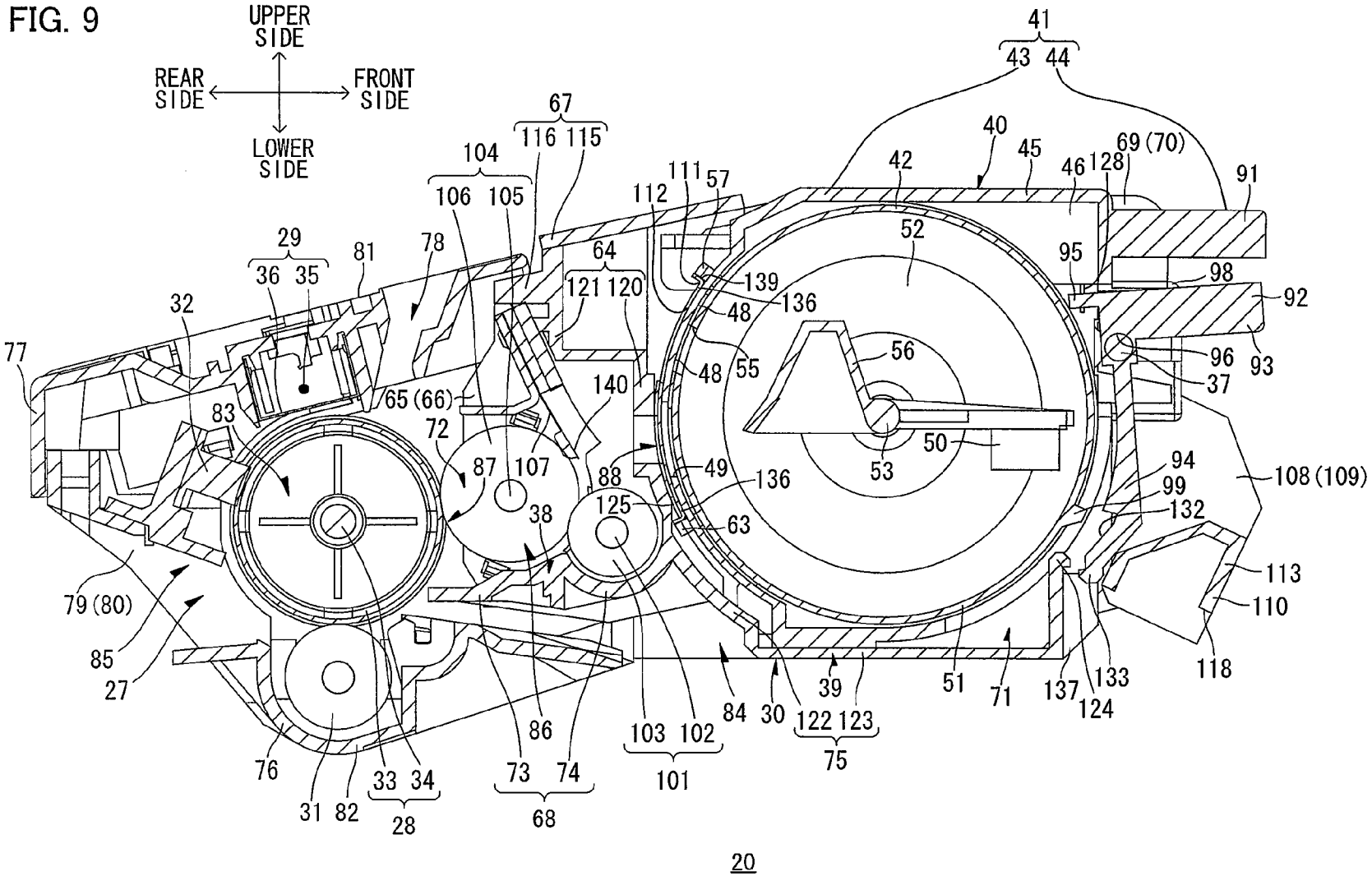
FIG. 9 is a left sectional side view of the processing unit in FIG. 7.

FIG. 8 is a left sectional side view of the processing unit in FIG. 6, while FIG. 9 is a left sectional side view of the processing unit in FIG. 7.

The processing unit 20 is provided at a lower portion of the scanning section 19 in the main body casing 2 and is detachably mountable to the main body casing 2 via the mounting port 6, as shown in FIG. 1. The mounting and removing directions of the processing unit 20 to and from the main body casing 2 are an obliquely downwardly rearward direction (mounting direction) and an obliquely upwardly forward direction (removing direction), respectively, as indicated by arrows in the drawing.

The processing unit 20 integrally includes a drum section 27 which forms the rear half portion of the processing unit 20, and a developing section 30 which forms the front half portion of the processing unit 20 as a unit main body, and further includes a toner box 40 which is removably mounted to the processing unit 20, as shown in FIG. 3.

(b-1) Drum Section

The drum section 27 includes a drum casing 76, and includes the photosensitive drum 28, a scorotron charger 29, a transfer roller 31 and a cleaning blush 32 which are provided in the drum casing 76.

The drum casing 76 is in a box shape whose longitudinal front portion in width direction is opened, and integrally includes a drum rear wall 77, a drum right wall 79 (see FIG. 2), a drum left wall 80(see FIG. 2), a drum top wall 81, and a drum bottom wall 82.

The drum right wall 79 and the drum left wall 80 are disposed in an opposed spaced relation with each other in the width direction as shown in FIG. 2.

The drum bottom wall 82 is extended between the lower end edges of the drum right wall 79 and the drum left wall 80. The drum top wall 81 is extended between the upper end edges of the drum right wall 79 and the drum left wall 80. The drum rear wall 77 is extended between the front end edges of the drum right wall 79 and the drum left wall 80, as shown in FIG. 3.

Midway in an anteroposterior direction of the drum top wall 81, a laser entrance port 78 is formed for the irradiation of the laser beams from the scanning section 19 to the photosensitive drum 28. A first passing port 84 is opened between the front end edge of the drum bottom wall 82 and the rear end edge of a developer rear bottom wall 68 of the developing section 30, which will be described later.

Midway in a vertical direction of the drum rear wall 77, a second passing port 85 is opened. Both of the first passing port 84 and the second passing port 85 are formed in a longitudinal rectangular shape in the width direction.

In this drum casing 76, the space defined by the drum rear wall 77, and, the rear half portions of the drum right wall 79, the drum left wall 80 and the drum bottom wall 82, and the drum top wall 81, forms a drum accommodation section 83 which accommodates the photosensitive drum 28, the scorotron charger 29, the transfer roller 31 and the cleaning blush 32. The drum accommodation section 83 is formed in a cylindrical shape whose front side and rear side are opened.

On the other hand, the space defined by the front half portions of the drum right wall 79, the drum left wall 80, and the drum bottom wall 82 forms a developer arrangement section 86 where the developing section 30 is arranged. The developer arrangement section 86 is formed as a bottomed frame in a flat-bottomed U-shape, as viewed in front cross section, whose upper side is opened.

The drum accommodation section 83 and the developer arrangement section 86 are communicating with each other.

The photosensitive drum 28 is in a cylindrical shape and includes a drum body 33 whose outermost layer is formed by a positively chargeable photosensitive layer formed of polycarbonate or the like, and a metal drum shaft 34 extending through the shaft center of the drum body 33 along an axial direction of the drum body 33. Both end portions of the drum shaft 34 in an axial direction are supported between the drum right wall 79 and the drum left wall 80 of the drum casing 76 (see FIG. 2). The drum body 33 is rotatably supported with respect to the drum shaft 34, and as a result, the photosensitive drum 28 is rotatable about the drum shaft 34 in the drum casing 76. A driving force from a motor (not shown) rotationally drives the photosensitive drum 28.

The scorotron charger 29 is supported on the drum top wall 81 of the drum casing 76 at the position obliquely rearward above the photosensitive drum 28 and disposed in opposed spaced relation with the photosensitive drum 28 so as not to contact to the photosensitive drum 28. This scorotron charger 29 includes a discharge wire 35 which is disposed in an opposed spaced relation with the photosensitive drum 28, and a grid 36 which is provided between the discharge wire 35 and the photosensitive drum 28 for controlling the amount of the charge from the discharge wire 35 to the photosensitive drum 28.

In this scorotron charger 29, a bias voltage is applied to the grid 36 and at the same time a high voltage is applied to the discharge wire 35 to generate corona discharge, thereby positively charging the surface of the photosensitive drum 28 uniformly.

The transfer roller 31 is provided below the photosensitive drum 28 in the drum casing 76, opposingly contacts with the photosensitive drum 28 in the vertical direction so as to form a nip between itself and the photosensitive drum 28, and the nip serves as the above described transfer position between the photosensitive drum 28 and the transfer roller 31.

In addition, the transfer roller 31 includes a metal roller shaft which is rotatably supported between the drum right wall 79 and the drum left wall 80 of the drum casing 76, and a rubber roller which is formed of a conductive rubber material and covers the roller shaft. The transfer roller 31 is applied with a transfer bias at the time of transfer. A driving force from a motor (not shown) rotationally drives the transfer roller 31.

The cleaning blush 32 is assembled onto the drum rear wall 77 of the drum casing 76 and disposed so as to opposingly contact with the photosensitive drum 28 at the position obliquely rearward above the photosensitive drum 28 and obliquely rearward below the scorotron charger 29 (upstream side of the scorotron charger 29 in a rotational direction of the photosensitive drum 28 (see the arrow in FIG. 3)).

(b-2) Developing Section

The developing section 30 is integrally formed with the drum section 27 in the developer arrangement section 86 of the drum casing 76.

This developing section 30 includes a developer casing 62 as a process casing, a feed roller 101, and a developing roller 104 as a developer carrier and a layer-thickness regulating blade 107 provided in the developer casing 62.

The developer casing 62 integrally includes a box-shaped rear-side casing 38 which is longitudinal in the width direction and whose rear side is opened, and a front-side casing 39 whose upper side and front side are opened and which has a width greater than the rear-side casing 38.

The rear-side casing 38 integrally includes a developer front wall 64, a developer right wall 65 (see FIG. 2), a developer left wall 66 (see FIG. 2), a developer top wall 67, and the developer rear bottom wall 68.

The developer right wall 65 and the developer left wall 66 are in a generally rectangular shape as viewed from side and disposed in an opposed spaced relation with each other in the width direction.

The developer rear bottom wall 68 is extended between the lower end edges of the developer right wall 65 and the developer left wall 66, and integrally includes a first bottom wall 73 and a second bottom wall 74 in this sequence from the rear in the anteroposterior direction.

The first bottom wall 73 is disposed on the rear side of the developer rear bottom wall 68, and formed in a tongue plate shape tilting downward from the front side toward the rear side.

The second bottom wall 74 is formed in generally semicircular shape as viewed in side section and extends continuously from the front end edge of the first bottom wall 73 along the feed roller 101.

The developer top wall 67 is extended between the upper end edges of the developer right wall 65 and the developer left wall 66 and integrally includes a first top wall 115 and a second top wall 116.

The first top wall 115 is disposed in front of the developer top wall 67 and extends toward the obliquely upwardly forward.

The second top wall 116 is formed in generally reversed L-shape as viewed in left side section which extends downward from the rear end edge of the first top wall 115 and then bents to extend backward.

The developer front wall 64 is extended between the front end edges of the developer right wall 65 and the developer left wall 66. The developer front wall 64 has an upper end edge connected to the above described bending portion of the second top wall 116 and a lower end edge connected to the front end edge of the second bottom wall 74, and integrally includes a longitudinal wall 120 which extends upward from the front end edge of the second bottom wall 74 and a bending wall 121 which is bent backward from the upper end edge of the longitudinal wall 120, then bent again and extends upward to be connected to the bending portion of the second top wall 116, and is formed in generally L-shape as viewed in left side section.

Rear end edges of the developer top wall 67, the developer left wall 65, the developer right wall 66 and the developer rear bottom wall 68 define an insertion hole 87 which is opened on the rear side of the rear-side casing 38. The insertion hole 87 is formed in a rectangular shape longitudinal in the width direction.

In the rear-side casing 38, the space defined by the developer front wall 64, the developer right wall 65, the developer left wall 66, the developer top wall 67, and the developer rear bottom wall 68 serves as a developing chamber 72 which accommodates the feed roller 101, the developing roller 104 and the layer-thickness regulating blade 107.

The front-side casing 39 is integrally formed with a right wall 69 (see FIG. 2) and a left wall 70 (see FIG. 2) as both side walls of the process casing, and a developer front bottom wall 75.

The developer front bottom wall 75 is formed in generally C-shape as viewed in side section and integrally includes a curved wall 122 which forms the rear half portion thereof and a L-shaped wall 123 which forms the front half portion thereof.

The curved wall 122 is formed in generally minor arc as viewed in side section and the front end edge thereof is connected to the rear end edge of the L-shaped wall 123.

The L-shaped wall 123 is formed in generally L-shape as viewed in side section which extends forward from the rear end edge thereof and is bent to extend upward. In the central portion in the width direction of the front end portion and the upper end portion of the L-shaped wall 123, an engagement portion 124 in a hook shape as viewed in side section which is bent at the upper end edge thereof and extends slightly forward, is integrally formed. As shown in FIG. 6, in the front end portion of the L-shaped wall 123, a positioning groove 138 which is concaved downward from the upper end edge of the front end portion of the L-shaped wall 123, is formed outwardly from the center of the width direction at each position spaced by a distance equivalent to approximately the one-quarter of the width size of the L-shaped wall 123.

The right wall 69 and the left wall 70 are disposed in opposed relation with each other in the width direction so as to sandwich the developer front bottom wall 75 therebetween and are formed in generally rectangular shape as viewed from side, as shown in FIG. 2. The obliquely upper front portion of the right wall 69 is cut out for ease of description in FIG. 2.

In the right wall 69 and the left wall 70, first insertion holes 97 which extend through the right wall 69 and the left wall 70 in the width direction are formed, respectively, at generally central positions thereof in the front-and-rear and up-and-down directions. The right wall 69 and the left wall 70 integrally include square columns 89 in the respective rear end portions of the laterally inner surfaces thereof, as shown in FIG. 4(*a*).

The square column 89 is formed in generally rectangular parallelepiped shape which is longitudinal in the vertical direction, and a guide groove 119 is formed in the upper end portion with the front end surface thereof being concaved toward the rear side. The square column 89 integrally includes a rib 90 on the laterally internal surface thereof below the guide groove 119. The rib 90 is formed to extend toward the laterally inner side so that the side section thereof forms generally a minor arc, and disposed so as to curve generally along the curved wall 122 of the developer front bottom wall 75 and to be in slightly spaced relation in the radial direction with respect to the curved wall 122, as shown in FIG. 8.

In this front-side casing 39, the portion defined by the right wall 69, the left wall 70, and the developer front bottom wall 75 forms a toner box accommodation chamber 71 which accommodates the toner box 40. The toner box accommodation chamber 71 is formed in a bottomed frame with the upper side and the front side thereof being opened.

The rear-side casing 38 and the front-side casing 39 are connected through the front side surface of the longitudinal wall 120 of the developer front wall 64 and the rear side surface of the curved wall 122 of the developer front bottom wall 75. A toner guiding port 88, which extends through the longitudinal wall 120 and the curved wall 122 in the thickness direction, is formed at the laterally central position of the connecting portion of the longitudinal wall 120 and the curved wall 122. The toner guiding port 88 is in a rectangular shape longitudinal in the width direction, and the toner guiding port 88 communicates the toner box accommodation chamber 71 and the developing chamber 72.

The toner box accommodation chamber 71 includes a shutter 111 as a process-side blocking member and a open/close lever 113 as a open/close member.

The shutter 111 is a thin plate formed as a minor arc having a circumference slightly shorter than the curved wall 122 as viewed in section, as shown in FIG. 3. A penetration hole 112, which is in a rectangular shape as viewed from front and extends through the shutter 111 in the thickness direction as shown in FIG. 4(*b*), is formed midway in a pivotal direction which will be described later, or more specifically, at the laterally central position of the upper half portion thereof. In each of the upper end portions and the lower end portions of both lateral end portions of the shutter 111, a notched portion 136 which is cut out in generally L-shape as viewed from front, is formed. In the upper end portions of the shutter 111 laterally inward from the respective notched portions 136, engagement portions 139 are provided respectively. The engagement portions 139 are engaged by respective second radial projections 57 of the toner box 40 when the toner box 40 is in the mounted state in the processing unit 20.

In the toner box accommodation chamber 71, the both lateral end portions of the shutter 111 are interposed between the curved wall 122 and the rib 90 of the square column 89, and thus the shutter 111 is pivotably supported along the side-sectional shape of the rib 90, as shown in FIG. 8

The shutter 111 can move between a developer closing position (see FIG. 8) which closes the toner guiding port 88 at a portion where the penetration hole 112 is not formed, and a developer opening position (see FIG. 3) where the penetration hole 112 and the toner guiding port 88 are disposed in opposed relation to allow the toner guiding port 88 to be released forward.

A seal member 125 is interposed between the curved wall 122 and the shutter 111. The seal member 125 is formed in a sheet shape, for example, of felt and the like and attached on the front side surface of the curved wall 122 so as not to block the toner guiding port 88.

The open/close lever 113 is formed in generally U-shape as viewed from top as shown in FIG. 4(*a*) and integrally includes a right support portion 108, a left support portion 109, and a process grasp portion 110.

The right support portion 108 and the left support portion 109 are formed in generally P-shaped thin plate as viewed from right side. In generally central position of the rear half portions of the right support portion 108 and the left support portion 109, round holes 114 are formed respectively and penetrate the right support portion 108 and the left support portion 109 in the thickness direction.

In each of the laterally outside surface of the right support portion 108 and the left support portion 109, a support cylinder 135 is provided in a position corresponding to the round hole 114. The support cylinder 135 has an inner diameter identical to the diameter of the round hole 114 and extends outwardly in the width direction. The support cylinder 135 has an outer diameter slightly smaller than the inner diameters of the first insertion holes 97 of the right wall 69 and the left wall 70 described above.

In the upper portion of the round holes 114 in the right support portion 108 and the left support portion 109, receiving portions 117 are formed respectively. Each of the receiving portions 117 has an upper end edge recessed toward the round hole 114 in generally U-shape as viewed from side.

The process grasp portion 110 is formed in generally rectangular shaped thin plate as viewed from front and extended between the front end portions of the right support portion 108 and the left support portion 109. The process grasp portion 110 has a grip portion 118 whose the lower end edge recesses upward at the laterally central position thereof The respective support cylinders 135 of the right support portion 108 and the left support portion 109 are fitted into the first insertion holes 97 of the right wall 69 and the left wall 70, so that the open/close lever 113 is rotatably supported on the right wall 69 and the left wall 70. Accordingly, the open/close lever 113 is allowed to move between a lever closing position (see FIG. 4(*b*)) in which the process grasp portion 110 of the open/close lever 113 is positioned below the round hole 114, and a lever opening position (see FIG. 4(*a*)) in which the process grasp portion 110 is arranged at the position identical to the round hole 114 in the vertical direction. The grip portion 118 is consistently exposed outward from the toner box accommodation chamber 71 as viewed from side irrespective of the position of the open/close lever 113, as shown in FIG. 3.

In the developing chamber 72 of the rear-side casing 38, the feed roller 101, the developing roller 104, and the layer-thickness regulating blade 107 are accommodated, as described above.

The feed roller 101 is disposed at obliquely rear side below the toner guiding port 88. The feed roller 101 includes a metal feed roller shaft 102, and a sponge roller 103 which is formed of a conductive foamed material and covers the feed roller shaft 102. Both axial end portions of the feed roller shaft 102 are rotatably supported on the developer right wall 65 and the developer left wall 66 at the positions corresponding to the second bottom wall 74 in the anteroposterior direction. A driving force from a motor (not shown) is input to the feed roller shaft 102 to rotationally drive the feed roller 101.

The developing roller 104 is disposed on the rear side of the feed roller 101 so as to be in contact with the feed roller 101 compressingly to each other. The developing roller 104 is longitudinal in the width direction and includes a metal developing roller shaft 105, and a rubber roller 106 which is formed of a conductive rubber material and covers the developing roller shaft 105.

Both axial end portions of the developing roller shaft 105 are rotatably supported on the developer right wall 65 and the developer left wall 66 at the positions corresponding to the first bottom wall 73 in the anteroposterior direction. The rubber roller 106 is formed of a conductive polyurethane rubber or a silicone rubber containing fine carbon particles and the like and the surface thereof is covered with a resin coating layer excellent in abrasion resistance such as polyurethane rubber or polyimide containing fluorine. A driving force from a motor (not shown) is input to the developing roller shaft 105 to rotationally drive the developing roller 104. The developing roller 104 is applied with developing bias during developing process via one lateral end portion of the developing roller shaft 105 exposed from the developer right wall 65, as shown in FIG. 2.

The layer-thickness regulating blade 107 is formed of a metal blade spring material and the distal end thereof includes a pressing member 140 which is in a generally semicircular shape as viewed in section and formed of electrically insulative or conductive silicone rubber or polyurethane rubber, as shown in FIG. 3. In the layer-thickness regulating blade 107, the proximal edge thereof is supported on the second top wall 116 of the developer top wall 67 above the developing roller 104, whereby the pressing member 140 thereof is in press contact to the developing roller 104 by the elastic force of the layer-thickness regulating blade 107.

In the drum section 27 and the developing section 30, the front end portion of the drum top wall 81 of the drum section 27 is fitted to the above described bending portion of the second top wall 116 of the developing section 30, and, the respective rear end edges of the developer right wall 65 and the developer left wall 66 of the developing section 30 are brought into abutment against the front end edges of the drum right wall 79 and the drum left wall 80 respectively, as shown in FIG. 2. Thus, the developing section 30 is assembled to the drum section 27. In a state where the developing section 30 is assembled with the drum portion 27, the first passing port 84 described above is formed between the developer rear bottom wall 68 and the drum bottom wall 82, as shown in FIG. 3.

(b-3) Toner Box

The toner box 40 is removably mounted to the toner box accommodation chamber 71, as described above. The toner box 40 can be mounted to and removed from the main body casing 2 by mounting and removing the processing unit 20 to and from the main body casing 2 via the mounting port 6 while the toner box 40 is in the mounted state in the processing unit 20. The mounting and removing directions of the toner box 40 to and from the toner box accommodation chamber 71 of the processing unit 20 are identical to the mounting and removing directions of the processing unit 20 to and from the main body casing 2, that is, the obliquely downwardly rearward direction (mounting direction) and the obliquely upwardly forward direction (removing direction), respectively. The direction orthogonal to the mounting and removing directions of the toner box 40 to and from the toner box accommodation chamber 71 is the width direction.

Since the toner box accommodation chamber 71 is positioned in front of the processing unit 20, when the front cover 7 is opened and the mounting port 6 is released, the toner box 40 is exposed from the mounting port 6, as shown in FIG. 1.

The toner box 40 is in generally a shape as viewed in left side section as shown in FIG. 3, and includes an outer casing 41 and an inner casing 42 which serve as a toner casing and are formed of resin and the like. Alternatively, only the outer casing 41 may serve as the toner casing.

(b-3-i) Outer Casing

The outer casing 41 is in generally a shape as viewed in section from the left side same as the toner box 40, and integrally includes a cylinder 43 and a guide lever 44 as a restricting member and a grasp portion.

As shown in FIG. 5(*a*), the cylinder 43 is formed as a hollow cylinder which is generally in a rectangular shape as viewed from side and longitudinal in the width direction, and includes an outer round wall 45, and a pair of outer side edge walls 46 which serve as both side walls of the toner casing and are formed as the both lateral side end faces of the outer round wall 45.

In the central position of the rear side surface of the outer round wall 45 in the right-and-left and up-and-down directions, a first toner ejecting port 49 is formed as a toner ejecting port which extends through the outer round wall 45 in the thickness direction. The first toner ejecting port 49 is formed in a rectangular shape longitudinal in the width direction.

In both lateral end portions of the rear side surface of the outer round wall 45, upper guide grooves 129 are formed respectively as first insertion grooves which extend through the outer round wall 45 in the thickness direction at the positions above the first toner ejecting port 49 and lower guide grooves 130 are formed respectively as second insertion grooves which extend through the outer round wall 45 in the thickness direction at the positions below the first toner ejecting port 49. Each of the upper guide grooves 129 and the lower guide grooves 130 is in a rectangular shape as view from the rear and longitudinal in the circumferential direction, the circumferential length thereof is set approximately twice as long as that of the first toner ejecting port 49, and the width length thereof is set approximately one-half of circumferential length of the first toner ejecting port 49.

In the lower portion of the front side surface of the outer round wall 45, positioning ribs 137 are formed respectively as ribs at positions which are spaced away by a distance equivalent to the one-quarter of the width size of the outer round wall 45 outwardly in the width direction from the center thereof, as shown in FIG. 6. The positioning rib 137 extends downwardly from the upper half portion of the front side surface of the outer round wall 45 in a continuous manner, and is bent to extend obliquely downwardly rearward, then is bent once again to extend rearward to continue to the rear half portion of the lower side surface of the outer round wall 45, and is thus formed in a generally isosceles trapezoid shaped thin plate as viewed from side. The positioning rib 137 has a width size slightly narrower than the groove width of the positioning groove 138 described above.

At a generally central position of each of the outer side edge walls 46 in anteroposterior and up-and-down directions, a second insertion hole 126 is formed which extends through each of the outer side edge walls 46 in the width direction, as shown in FIG. 5(*a*). Further, in each of the outer side edge walls 46, an insertion groove 127 is formed as a third insertion groove which extends through each of the outer side edge walls 46 in the width direction, and which is a minor arc concentric to the second insertion hole 126 at a radially outside position of the second insertion hole 126, specifically, in a range from 12 o'clock position to 2 o'clock position as viewed from left side.

Further, each of the outer side edge walls 46 is integrally formed with a positioning projection 131 which extends backward at a position corresponding to the upper end edge of the upper guide groove 129 and is bent to protrude outwardly in the width direction. The portion of the positioning projection 131 which protrudes outwardly in the width direction is formed in a column shape having an outer diameter smaller than the groove width of the guide groove 119 (see FIG. 4(*a*)) of the front-side casing 39 of the processing unit 20 described above.

The guide lever 44 is disposed at the upper end portion of the front side surface and the laterally central position of the outer round wall 45, and includes a fixing member 91, and a swinging member 92 as a toner grasp portion and a engaging member, as shown in FIG. 6.

The fixing member 91 is formed in generally rectangular shape as viewed from top and is longitudinal in the width direction, and the rear end portion thereof is fixed to the outer round wall 45, as shown in FIG. 8.

The swinging member 92 is formed in generally rectangular shape as viewed from top and generally T-shape as viewed in side section, and includes integrally a grip portion 93, a first restricting portion 94, and a second restricting portion 95.

The grip portion 93 and the second restricting portion 95 are formed in generally rectangular shape as viewed from top.

The first restricting portion 94 is formed in rectangular shape as viewed from front and generally J-shape as viewed from left in section. The lower end portion thereof includes a first engaging portion 132 and a second engaging portion 133 as an engaging portion in this order from the top. The first engaging portion 132 is formed as a groove extending in the width direction so that the rear side surface of the lower end portion of the first restricting portion 94 recesses forward. The second engaging portion 133 is formed in generally hook shape as viewed from left in section in which the lowest ent portion of the first restricting portion 94 slightly bends rearward below the first engaging portion 132.

Furthermore, the rear end portion of the grip portion 93, the upper end portion of the first restricting portion 94, and the front end portion of the second restricting portion 95 are connected with one another. In the connecting position between the rear end portion of the grip portion 93 and the upper end portion of the first restricting portion 94, a shaft insertion hole 96 is formed to extend through the grip portion 93 and the first restricting portion 94 in the width direction.

On the front side surface of the outer round wall 45, a pair of shaft support portions 98 are integrally formed so as to protrude forward and laterally sandwich the grip portion 93 of the swinging member 92 therebetween. An insertion shaft 37 extended between the pair of shaft support portions 98 is inserted through the shaft insertion hole 96 of the swinging member 92, so that the swinging member 92 is swingably supported on the outer round wall 45.

Further, the rear end portion of the fixing member 91 and the second restricting portion 95 of the swinging member 92 are connected by an elastic member 128.

Specifically, the elastic member 128 is, for example, a blade spring, and the one end portion thereof is threaded to the rear end portion of the fixing member 91 with a screw 134, and the other end portion is engaged to the second restricting portion 95. Thus, the swinging member 92 is continuously urged in a clockwise direction about the insertion shaft 37 so that the second restricting portion 95 comes close to the fixing member 91 by an urging force of the elastic member 128.

(b-3-ii) Inner Casing

The inner casing 42 is longitudinal in the width direction, is formed in a hollow column having a size smaller than the cylinder 43 of the outer casing 41, and integrally includes a cylindrical inner round wall 51 as a toner-side blocking member, and a pair of flat disc-like inner side edge walls 52 for blocking both lateral side surfaces of the inner round wall 51, as shown in FIG. 5(*c*). Between the centers of the circles of the respective inner side edge walls 52 which oppose to each other in the width direction, an agitator rotating shaft 53 is extended as a shaft, as shown in FIG. 3. The agitator rotating shaft 53 is rotatably supported on the inner side edge walls 52, and is provided with an agitator 56 as an agitating portion. The agitator 56 is provided with wipers 50. The wipers 50 are formed of, for example, a rubber and mounted to both axial (lateral) end portions of the agitator rotating shafts 53. The center of pivot of the open/close lever 113 described above and the center of the agitator rotating shaft 53 substantially coincide with each other. The agitator rotating shaft 53 and the agitator 56 serve as an agitating member.

The both lateral end portions of the agitator rotating shaft 53 protrude outward in the width direction from the respective inner side edge walls 52, as shown in FIG. 5(*c*). A collar 100 is fit onto each of the protruding portions of the agitator rotating shaft 53. The collar 100 has an outer diameter slightly smaller than the hole diameter of the second insertion hole 126(see FIG. 5(*a*)) of the outer casing 41.

On the inner side edge walls 52, lateral projections 54 are respectively provided as first projections which protrude outwardly in the width direction at positions which are radially outward from the agitator rotating shaft 53 and oppose to each other in the width direction. Each of the lateral projections 54 is formed in generally minor arc shape as viewed from side and the circumferential length thereof is approximately one-half of that of the insertion groove 127 of the outer casing 41 (described above), and the radial length thereof is slightly smaller than the groove width of the insertion groove 127.

Moreover, at one portion on a circumference in the lateral center of the inner round wall 51, specifically, at a position shifted by approximately 90° in a counterclockwise direction with respect to the lateral projection 54 as viewed from the left side, a second toner ejecting port 55 is formed, and extends through the inner round wall 51 in the thickness direction. The second toner ejecting port 55 is formed in a rectangular shape with a size generally identical to that of the first toner ejecting port 49 of the outer casing 41 as viewed from the radial outside.

On the inner round wall 51, a first radial projection 48 is provided along a circumferential edge of the second toner ejecting port 55 and protrudes outward in the radial direction. The first radial projection 48 is formed in a shape of a rectangular frame as viewed from the radial outside, and formed of elastic materials, such as rubber.

On both lateral end portions of the inner round wall 51, the second radial projections 57 are integrally provided, respectively, at positions slightly above the upper end edge of the first radial projection 48 and protrude outward in the radial direction. Further, on the both lateral end portions of the inner round wall 51, third radial projections 63 are integrally provided, respectively, and protrude outward in the radial direction at positions below the lower end edge of the first radial projection 48. The second radial projection 57 and the third radial projection 63 serve as second projections and are formed to have an identical size. The lateral lengths thereof are designed to be smaller than the groove widths of the upper guide groove 129 and the lower guide groove 130 of the outer casing 41.

Further, on the inner round wall 51, a fourth radial projection 99 is formed at a position opposite to the second toner ejecting port 55 in relation to the shaft center of the inner casing 42, and protrudes outward in the radial direction and extends along the width direction, as shown in FIG. 3.

(b-3-iii) Assembling of Inner Casing into Outer Casing

In the toner box 40 described above, the inner casing 42 is accommodated in the outer casing 41, and both lateral end portions of the agitator rotating shafts 53 of the inner casing 42 are engaged respectively into the second insertion holes 126 of the outer casing 41 together with the collars 100 described above, as shown in FIG. 5(*a*). Thereafter, each of the lateral projections 54 of the inner casing 42 is protruded outward in the width direction from each of the insertion grooves 127 of the outer casing 41, each of the second radial projections 57 of the inner casing 42 is protruded outward in the radial direction of the inner casing 42 from each of the upper guide grooves 129 of the outer casing 41, and each of the third radial projections 63 of the inner casing 42 is protruded outward in the radial direction of the inner casing 42 from each of the lower guide grooves 130 of the outer casing 41.

Accordingly, the inner casing 42 is assembled into the outer casing 41, and the inner casing 42 is pivotably supported on both of the outer side edge walls 46 of the outer casing 41. As a result, each of the lateral projections 54 is allowed to slide along the corresponding insertion groove 127, each of the second radial projections 57 is allowed to slide along the corresponding upper guide groove 129, and each of the third radial projections 63 is allowed to slide along the corresponding lower guide groove 130. The direction of the pivot axis of the inner casing 42 is the width direction.

When the toner box 40 thus assembled is in a state not being mounted to the processing unit 20 as shown in FIG. 8, the first engaging portion 132 in the first restricting portion 94 of the outer casing 41 engages with the fourth radial projection 99 of the inner casing 42, and the pivot of the inner casing 42 to the outer casing 41 is restricted. This state of the swinging member 92 will hereinafter be referred to as a first state.

In the first state as described above, when the fixing member 91 and the swinging member 92 are held together, the swinging member 92 swings in a counterclockwise direction about the insertion shaft 37 against the urging force of the elastic member 128. After the fixing member 91 and the swinging member 92 are held together for a while, the swinging of the swinging member 92 stops. This state of the swinging member 92 will hereinafter be referred to as a second state.

In the second state, as shown in FIG. 9, the first engaging portion 132 of the afore-described first restricting portion 94 is apart from the fourth radial projection 99 of the inner casing 42, and the engagement of the first engaging portion 132 with the fourth radial projection 99 is released. However, the rear end portion of the second restricting portion 95 is brought into abutment against the inner round wall 51 of the inner casing 42, so that the pivot of the inner casing 42 with respect to the outer casing 41 is restricted.

Therefore, when the swinging member 92 is in a third state which is between the first state and the second state, the engagement between the first engaging portion 132 and the fourth radial projection 99 is released and additionally, the rear end portion of the second restricting portion 95 is not brought into abutment against the inner round wall 51 of the inner casing 42, the restriction against the pivot of the inner casing 42 with respect to the outer casing 41 is released, as shown in FIG. 3. In this case, when the inner casing 42 is pivoted with respect to the outer casing 41, each of the lateral projections 54 is guided to the corresponding insertion groove 127, each of the second radial projections 57 is guided to the corresponding upper guide groove 129, and each of the third radial projections 63 is guided to the corresponding lower guide grooves 130, as shown in FIG. 5(*b*). At the time of pivot of the inner casing 42 with respect to the outer casing 41, the first radial projection 48 of the inner casing 42 is in sliding contact with the internal side surface of the outer round wall 45 of the outer casing 41, whereby the outer casing 41 and the inner casing 42 are kept in air-tight and fluid-tight manner, as shown in FIG. 3.

Moreover, when the swinging member 92 is in the third state, the inner casing 42 can move to a toner blocking position where the internal spaces of the outer casing 41 and the inner casing 42 are sealed by blocking the first toner ejecting port 49 of the outer casing 41 by a portion other than the second toner ejecting port 55 in the inner round wall 51, as shown in FIG. 5(*b*). At this time, each of the second radial projections 57 is brought into abutment against the upper end edge of the corresponding upper guide groove 129, each of the third radial projections 63 is brought into abutment against the upper end edge of the corresponding lower guide groove 130, and each of the lateral projections 54 is brought into abutment against the front end edge of the corresponding insertion groove 127. On the other hand, the inner casing 42 can be moved to a toner opening position in which the first toner ejecting port 49 and the second toner ejecting port 55 are oppose to each other to open the internal portion of the outer casing 41 and the internal portion of the inner casing 42, and at the same time, each of the second radial projections 57 is brought into abutment against the lower end edge of the corresponding upper guide groove 129, each of the third radial projections 63 is brought into abutment against the lower end edge of the corresponding lower guide groove 130, and each of the lateral projections 54 is brought into abutment against the rear end edge of the corresponding insertion groove 127, as shown in FIG. 5(*a*).

In the inner casing 42, a positively chargeable non-magnetic single-component toner is contained as a developing agent. As the toner, a polymerized toner is used. The polymerized toner is obtained by copolymerizing polymerizable monomers, for example, styrene monomers such as styrene, and acrylic monomers such as acrylic acid, alkyl (C1 to C4) acrylate, and alkyl (C1 to C4) methacrylate through suspension polymerization and the like. The polymerized toner is generally in spherical shape, extremely excellent in fluidity, and can achieve high quality image formation.

In such toner, a coloring agent such as carbon black or wax is mixed. Additionally, an additive agent such as silica is added to improve the fluidity. The toner has an average particle size of approximately 6 to 10 μm.

(b-4) Mounting and Removal of Toner Box to and from Processing Unit (b-4-i) Mounting of Toner Box to Processing Unit To the toner box accommodation chamber 71 of the processing unit 20 which is in a state where the open/close lever 113 is in the lever closing position and the shutter 111 is in the developer closing position, as shown in FIG. 8, the toner box 40 in which inner casing 42 is in the toner blocking position is mounted from the obliquely upper front side to the obliquely lower rear side. At this time, as shown in FIG. 6, each of the positioning projections 131 of the toner box 40 is guided to the corresponding guide groove 119 of the toner box accommodation chamber 71 of the processing unit 20. Further, the swinging member 92 of the toner box 40 is in the first state and the pivot of the inner casing 42 with respect to the outer casing 41 is restricted.

When each of the positioning projections 131 reaches to the deepest portion of the corresponding guide groove 119 and is brought into abutment against the deepest portion, each of the lateral projections 54 of the toner box 40 is engaged with the corresponding receiving portion 117 of the open/close lever 113 in the lever closing position, as shown in FIG. 7. At this time, as shown in FIG. 9, each of the second radial projections 57 of the toner box 40 engages with the corresponding engaged portion 139 of the shutter 111 of the toner box accommodation chamber 71, and the shutter 111 is sandwiched by the corresponding second radial projection 57 and third radial projection 63 in the direction of the pivot thereof. The swinging member 92 is in the third state (see FIG. 3) when the second engaging portion 133 engages to the engagement portion 124.

The positioning rib 137 of the toner box 40 is fitted in the positioning groove 138 of the processing unit 20, as shown in FIG. 7. In this manner, the outer casing 41 of the toner box 40 is positioned with respect to the toner box accommodation chamber 71 and the mounting of the toner box 40 to the developing section 30 of the processing unit 20 is completed. At this time, the first toner ejecting port 49 in the outer casing 41 of the toner box 40 is opposed to the toner guiding port 88 in an anteroposterior direction with the shutter 111 sandwiched therebetween (see FIG. 9).

In a state where the toner box 40 is completely mounted in the processing unit 20, the swinging member 92 is in the third state as described above, and thus the inner casing 42 is pivotable in relation to the outer casing 41. Moreover, since each of the lateral projections 54 of the inner casing 42 is engaged with the corresponding receiving portion 117 of the open/close lever 113 which is in the lever closing position, when the open/close lever 113 is moved from the lever closing position to the lever opening position (see FIG. 2), the inner casing 42 pivots from the toner closing position (see FIG. 9) to the toner opening position (see FIG. 3) and thus the first toner ejecting port 49 and the second toner ejecting port 55 are opposed and communicates to each other, as shown in FIG. 3. When the inner casing 42 pivots, the shutter 111 which is sandwiched between the corresponding second radial projection 57 and third radial projection 63 of the inner casing 42 also pivots from the developer closing position (see FIG. 9) to the developer opening position, and the penetration hole 112 of the shutter 111 and the toner guiding port 88 of the toner box accommodation chamber 71 are opposed to each other.

In the toner box accommodation chamber 71 in which the shutter 111 is at the developer opening position, and in the toner box 40 in which the inner casing 42 is at the toner opening position, the penetration hole 112 and the toner guiding port 88 which are in the opposed state in the toner box accommodation chamber 71, and the first toner ejecting port 49 and the second toner ejecting port 55 which are in the opposed state in the toner box 40, are opposed and communicate to each other. As a result, the internal portion of the inner casing 42 of the toner box 40 and the internal portion of the developing chamber 72 of the developing section 30 communicate to each other via the toner guiding port 88, the penetration hole 112, the first toner ejecting port 49 and the second toner ejecting port 55.

As described above, since a space between the outer casing 41 where the first toner ejecting port 49 is formed and the inner casing 42 where the second toner ejecting port 55 is formed, is kept in air-tight and fluid-tight manner by the first radial projection 48, and further, since the seal member 125 is interposed in a space between the shutter 111 where the penetration hole 112 is formed and the curved wall 122 where the toner guiding port 88 is formed, the toner is prevented from leaking off to the outside from the toner guiding port 88, the penetration hole 112, the first toner ejecting port 49, and the second toner ejecting port 55.

(b-4-ii) Removing of Toner Box from Processing Unit

In a state where the shutter 111 is in the developer opening position and the inner casing 42 is in the toner opening position, the open/close lever 113 which is in the lever opening position, is moved to the lever closing position as shown in FIG. 9. At this time, the inner casing 42 in which each of the lateral projections 54 is engaged with the corresponding receiving portion 117 of the open/close lever 113, pivots from the toner opening position to the toner closing position, whereby the first toner ejecting port 49 of the outer casing 41 is blocked by a portion of the inner round wall 51 other than the second toner ejecting port 55 and the internal portions of the outer casing 41 and the inner casing 42 are sealed. In other words, the communication between the first toner ejecting port 49 and the second toner ejecting port 55 is stopped. When the inner casing 42 pivots, the second radial projections 57 and the third radial projections 63 pivot accordingly. As a result, the shutter 111, which is sandwiched by the corresponding second radial projection 57 and third radial projection 63, pivots from the developer opening position to the developer closing position, whereby the toner guiding port 88 of the toner box accommodation chamber 71 is blocked by a portion of the shutter 111 other than the penetration hole 112.

In this state, since the first restricting portion 94 is in the third state and the second engaging portion 133 is engaged with the engaged portion 124, as shown in FIG. 3, the swinging member 92 is swung to the second state and the engagement between the second engaging portion 133 and the engaged portion 124 is released, as shown in FIG. 9. While the swinging member 92 is remained in the second state (the swinging member 92 is held), the toner box 40 is drawn out toward the obliquely upwardly forward direction from the toner box accommodation chamber 71. At this time, each of the positioning projections 131 (see FIG. 6) of the toner box 40 is guided to the corresponding guide groove 119 (see FIG. 6) in the toner box accommodation chamber 71. When the holding of the toner box 40 which has been drawn out, is released, the swinging member 92 is brought into the first state.

Thereafter, as shown in FIG. 8, each of the positioning projections 131 is out from the corresponding guide groove 119, the engagement (see FIG. 7) between each of the lateral projections 54 of the toner box 40 and the corresponding receiving portion 117 of the open/close lever 113 is released, and the engagement between each of the second radial projections 57 of the toner box 40 and the corresponding engaged portion 139 of the shutter 111 is released, whereby the removal of the toner box 40 from the processing unit 20 is completed.

(b-5) Developing and Transferring Operation

As described in (b-4-i) above and as shown in FIG. 3, after the toner box 40 is mounted to the processing unit 20 and accommodated in the toner box accommodation chamber 71, a driving force from a motor (not shown) is input to the agitator rotating shaft 53 when an image is formed by the laser printer 1.

Then, the agitator rotating shaft 53 is rotated in clockwise direction as viewed from left and the agitator 56 moves about the agitator rotating shaft 53 in circumferential direction in the internal space of the inner casing 42 of the toner box 40. Accordingly, the toner in the toner box 40 is stirred by the agitator 56 and released into the developing chamber 72 via the second toner ejecting port 55, the first toner ejecting port 49, the penetration hole 112, and the toner guiding port 88. In accordance with the rotation of the agitator rotating shaft 53, each of the aforedescribed wipers 50 of the agitator 56 wipes a toner detecting window (not shown) provided in the corresponding inner side edge wall 52 of the inner casing 42, thereby cleaning the toner detecting windows (not shown) by the wipers 50.

The toner released from the toner guiding port 88 into the developing chamber 72 is fed to the developing roller 104 by the rotation of the feed roller 101. At this time, the toner is triboelectrically positively charged between the feed roller 101 and the developing roller 104. In accordance with the rotation of the developing roller 104, the toner fed onto the developing roller 104 enters between the pressing member 140 of the layer-thickness regulating blade 107 and the rubber roller 106 of the developing roller 104, and are carried as a thin layer with a uniform thickness on the developing roller 104.

In accordance with the rotation of the photosensitive drum 28, the surface of the photosensitive drum 28 is uniformly positively charged by the scorotron charger 29, and then exposed by laser beams of high-speed scanning from the scanning section 19, and finally an electrostatic latent image which corresponds to the image to be formed on the sheet, 3 is formed.

Thereafter, by the rotation of the developing roller 104, the toner which is carried on the developing roller 104 and positively charged, opposingly contacts with the photosensitive drum 28. At this time, the toner is fed to the electrostatic latent image formed on the surface of the photosensitive drum 28, that is, a portion exposed by laser beams and has lower potential on the surface of the uniformly positively charged photosensitive drum 28. Consequently, the electrostatic latent image on the photosensitive drum 28 is visualized and the toner image by reversal developing is carried on the surface of the photosensitive drum 28.

After that, the toner image carried on the surface of the photosensitive drum 28 is transferred on the sheet 3 which is transported by the resist roller 15 (see FIG. 1) and enters from the first passing port 84 into the drum casing 76. During the passage of the sheet 3 through a transfer position between the photosensitive drum 28 and the transfer roller 31, the toner image is transferred onto the sheet 3 by transfer bias applied on the transfer roller 31.

The sheet 3 having a transferred toner image is ejected from the second passing port 85 to the outside of the drum casing 76 and transported to the fixing section 21.

The toner remaining on the photosensitive drum 28 after the transfer is recovered by the developing roller 104.

(c) Fixing Section

The fixing section 21 is provided in back of the processing unit 20 and disposed in generally anteroposteriorly spaced relation to the photosensitive drum 28 of the processing unit 20, as shown in FIG. 1. The fixing section 21 includes a fixing frame 59, and a heating roller 60 and a pressure roller 61 in the fixing frame 59.

In the fixing section 21, the toner image which has been transferred onto the sheet 3 in the transfer position, is thermally fixed on the sheet 3 when the sheet 3 passes between the heating roller 60 and the pressure roller 61. The sheet 3 fixed with the toner image is transported to the sheet ejecting transport path and then transported to a sheet ejecting roller 141 by a transport roller 63, and is finally ejected onto a sheet ejection tray 58 by the ejecting roller 141. The sheet ejection tray 58 is formed on the upper surface of the main body casing 2.

2. Operations and Effects of the Embodiment

As described above, in the laser printer 1, when the toner box 40 is not in the state of being mounted in the toner box accommodation chamber 71 in the developing section 30 of the processing unit 20 (hereinafter, referred to as "mounting of the toner box 40 in the processing unit 20"), the open/close lever 113 of the processing unit 20 is not engaged with each of the lateral projections 54 of the inner casing 42 of the toner box 40. This restricts the pivot of the inner casing 42 and can thus prevent inadvertent opening and closing of the first toner ejecting port 49 of the outer casing 41 by the inner round wall 51 of the inner casing 42.

When the toner box 40 is mounted in the processing unit 20, each of the lateral projections 54 is engaged to the corresponding receiving portion 117 of the open/close lever 113, and each of the second radial projections 57 of the inner casing 42 is engaged to the corresponding engaged portion 139 of the shutter 111 of the toner box accommodation chamber 71 thereby sandwiching the shutter 111.

This state allows, in accordance with the movement of the open/close lever 113, the pivot of the inner round wall 51 by the lateral projections 54, that is, the opening and closing of the first toner ejecting port 49, and the pivot of the shutter 111 by the second radial projections 57 and the third radial projections 63 in conjunction with the lateral projections 54, that is, the opening and closing of the toner guiding port 88.

Therefore, when the open/close lever 113 is moved to the lever opening position while the toner box 40 is in the mounted state in the processing unit 20, the inner round wall 51 of the inner casing 42 pivots to the toner opening position, the shutter 111 pivots to the developer opening position, and the toner guiding port 88 and the first toner ejecting port 49 are released. This allow the toner guiding port 88 and the first toner ejecting port 49 to communicate with each other, and further, the internal portion of the inner casing 42 of the toner box 40 and the internal portion of the developing chamber 72 of the developing section 30 to communicate with each other, and thus the toner can be fed from the toner box 40 into the developing chamber 72 of the processing unit 20.

The open/close lever 113 is moved to the lever closing position while the toner box 40 is in a mounted state to the processing unit 20, to pivot the inner round wall 51 and the shutter 111 to the toner closing position and the developer closing position, respectively, so that the toner guiding port 88 and the first toner ejecting port 49 are blocked. This allows the toner box 40 to be removed from the processing unit 20 while preventing the toner leakage from the toner guiding port 88 and the first toner ejecting port 49.

When the toner box 40 is in a removed state from the processing unit 20, the shutter 111 is not sandwiched between the second radial projections 57 and the third radial projections 63 of the toner box 40, and therefore, the shutter 111 is not pivoted even if the open/close lever 113 is operated and the toner guiding port 88 can be kept blocked. As for the toner box 40, as described above, the inner round wall 51 is not pivoted when the toner box 40 is in a removed state from the processing unit 20 and the first toner ejecting port 49 can be kept blocked.

As a result, with a simple configuration, the leakage from the toner box 40 and the processing unit 20 can be prevented.

Further, with the simple configuration in which the toner box 40 is provided with the lateral projections 54, the second radial projections 57 and the third radial projections 63, the above described open and close operation of the first toner ejecting port 49 and the toner guiding port 88 can be achieved.

The lateral projections 54, the second radial projections 57, and the third radial projections 63 are provided in the both lateral end portions of the inner casing 42, and disposed at positions apart from the first toner ejecting port 49, more specifically, disposed at positions apart from the first toner ejecting port 49 when projected from a direction orthogonal (anteroposterior direction and up-and-down direction) to the longitudinal direction (width direction) of the developing roller 104.

Accordingly, in a mounted state of the toner box 40 in the processing unit 20, the lateral projections 54, the second radial projections 57, and the third radial projections 63 can stably pivot the inner round wall 51 and the shutter 111. When the inner casing 42 is pivoted to release the first toner ejecting port 49, the lateral projections 54, the second radial projections 57, and the third radial projections 63 do not interfere with the first toner ejecting port 49 and the first ejecting port 49 and the guiding port 88 can thus be reliably communicated to each other, whereby the toner is reliably fed from the toner box 40 into the developing chamber 72 of the processing unit 20.

The shutter 111 is pivotably supported along the sectional shape of the ribs 90 on the right wall 69 and the left wall 70 which are both lateral side walls of the developer casing 62 of the processing unit 20, thereby the toner guiding port 88 can be stably opened and closed.

Further, the inner casing 42 having the inner round wall 51 is rotatably supported by each of the outer side edge walls 46, which are the both side walls in the width direction of the outer casing 41, thereby the first toner ejecting port 49 can be stably opened and closed.

As described above, the inner round wall 51 and the shutter 111 are pivotably supported at both lateral end portion sides of the toner box 40 and the processing unit 20, respectively, and thus no extra mechanism is disposed in the first ejecting port 49 and the guiding port 88, whereby the toner box 40 and the processing unit 20, or more specifically, the first ejecting port 49 and the guiding port 88 can be closely joined to each other in a mounted state of the toner box 40 in the processing unit 20. Accordingly, in this configuration, the toner leakage can hardly occur between the toner box 40 and the processing unit 20. Further, in this configuration, a space is formed at the central portion between both side walls (right wall 69 and left wall 70) of the developer casing 62 in the processing unit 20, the toner box 40 can more easily access to the processing unit 20 during mounting and removing of the toner box 40 to and from the processing unit 20.

Further, when the processing unit 20 is in a mounted state in the main body casing 2, the toner box 40 can be mounted to and removed from the processing unit 20. Specifically, since the toner box accommodation chamber 71 which accommodates the toner box 40 is disposed on the front side of the processing unit 20, the toner box 40 is exposed from the mounting port 6 when the front cover 7 of the main body casing 2 is opened to release the mounting port 6.

Accordingly, when the toner box 40 is mounted to and removed from the main body casing 2 for the purpose of replacing the toner box 40, for example, the processing unit 20 need not to be mounted to and removed together with the toner box 40, thereby the operability is improved.

The mounting and removing directions of the toner box 40 to and from the processing unit 20 are obliquely downwardly rearward direction (mounting direction) and obliquely upwardly forward direction (departing direction), respectively. The mounting and removing directions are directions orthogonal to the longitudinal direction (width direction) of the developing roller 104. Since the toner box 40 can be mounted to and removed from the processing unit 20 in a direction orthogonal to the longitudinal direction of the developing roller 104, the toner guiding port 88 and the first toner ejecting port 49 can be opposed to the developing roller 104 in the mounted state of the toner box 40 in the processing unit 20. As a result, the dispositions and the sizes of the toner guiding port 88 and the first toner ejecting port 49 can be set as desired. In other words, the toner can be fed with ease from the toner box 40 to the processing unit 20.

Further, the toner box 40 is provided with the guide lever 44, and since the pivot of the inner round wall 51 is restricted by the guide lever 44 when the toner box 40 is not in the mounted state in the processing unit 20, the fear of undesired pivot of the inner round wall 51 can be resolved, the first toner ejecting port 49 can be kept blocked, and the leakage of the toner from the toner box 40 can be prevented. On the other hand, in the mounted state of the toner box 40 in the processing unit 20, the restriction on the pivot of the inner round wall 51 is released by the guide lever 44, and thus the first toner ejecting port 49 is released, and the toner can be reliably fed from the toner box 40 into the developing chamber 72 of the processing unit 20.

The guide lever 44 includes the swinging member 92 and the swinging member 92 can be swung between the first state and the second state in accordance with the gripping force of the swinging member 92. In the first state, the first engaging portion 132 of the first restricting portion 94 of the swinging member 92 engages with the fourth radial projection 99 of the inner round wall 51, and in the second state, the rear end portion of the second restricting portion 95 of the swinging member 92 is brought into abutment against the inner round wall 51 of the inner casing 42, whereby the pivot of the inner round wall 51 can be restricted. In the third state between the first state and the second state, the engagement between the first engaging portion 132 and the fourth radial projection 99 is released, and the rear end portion of the second restricting portion 95 is not in abutment against the inner round wall 51 of the inner casing 42, whereby the restriction on the pivot of the inner casing 42 with respect to the outer casing 41 can be released.

Accordingly, the pivot and the restriction of rotation of the inner round wall 51 can be performed by the swinging member 92, thereby the toner leakage from the toner box 40 can be prevented. Further, since the toner box 40 can be gripped by the swinging member 92, the operability can be improved. Further, the toner box 40 can be configured more simply compared with the case where the swinging member 92 is provided separately from the guide lever 44. Further, since the first restricting portion 94 and the second restricting portion 95 are provided for restricting the pivot of the inner round wall 51 in accordance with the first state and the second state of the swinging member 92, a simple configuration of the toner box 40 can be achieved compared with the configuration where the pivot of the inner round wall 51 is restricted by a single restricting portion in accordance with the first state and the second state.

The swinging member 92 of the guide lever 44 is provided with the second engaging portion 133, which engages with the engagement portion 124 of the developer casing 62 of the processing unit 20 in the mounted state of the toner box 40 in the processing unit 20, whereby the toner box 40 is reliably positioned with respect to the processing unit 20, and the toner can be reliably fed into the developing chamber 72 of the processing unit 20 from the toner box 40. Further, the toner box 40 can be configured simply compared with the case where the swinging member 92 is provided separately from the second engaging portion 133.

Further, the open/close lever 113 described above is provided with the process grasp portion 110, and the mounting and removing of the processing unit 20 to and from the main body casing 2 can be performed by gripping this process grasp portion 110, thereby the operability is improved. Further, the processing unit 20 can be configured simply compared with the case where the process grasp portion 110 is provided separately from the open/close lever 113.

The laser printer 1 having such toner box 40 and processing unit 20 can prevent the toner leakage from the toner box 40 and the processing unit 20 with a simple configuration.

Further, since the pivot center of the open/close lever 113 and the axial center of the agitator rotating shaft 53 are substantially coincided, the pivot of the open/close lever 113 and the rotation of the agitator 56 about the agitator rotating shaft 53 can be prevented from interfering with each other. Further, a driving force can be transmitted to the agitator rotating shaft 53 without interfering with the pivoting open/close lever 113, and the attitude of the toner box 40 can be stabilized when the open/close lever 113 is pivoted.

In this configuration, when the toner box 40 is not in a mounted state in the processing unit 20, the open/close lever 113 on the processing unit 20 side is not engaged with the lateral projection 54 of the toner box 40. Therefore, the pivot of the inner casing 42 of the toner box 40 is restricted and undesired communication between the first toner ejecting port 49 and the second toner ejecting port 55 can be prevented.

When the toner box 40 is mounted in the processing unit 20, each of the lateral projections 54 is engaged with the corresponding open/close lever 113. Accordingly, in accordance with the movement of the open/close lever 113, the lateral projection 54 can pivot the inner casing 42, the second radial projection 57 and the third radial projection 63 which are interlocked with the lateral projections 54, can pivot the shutter 111, that is, the toner guiding port 88 can be opened and closed. Further, the inner casing 42 pivots to communicate the first toner ejecting port 49 and the second toner ejecting port 55 with each other or stop the communication thereof.

Accordingly, when the first toner ejecting port 49 and the second toner ejecting port 55 are communicated with each other and the toner guiding port 88 is released in the mounted state of the toner box 40 in the processing unit 20, the first toner ejecting port 49, the second toner ejecting port 55, and the toner guiding port 88 communicate with one another and the toner can be fed from the inner casing 42 of the toner box 40 to the processing unit 20.

When the communicated state between the first toner ejecting port 49 and the second toner ejecting port 55 is stopped and the toner guiding port 88 is blocked in the mounted state of the toner box 40 in the processing unit 20, the toner box 40 can be removed from the processing unit 20 without toner leakage from the toner guiding port 88 and the first toner ejecting port 49.

Further, in the processing unit 20, in the state where the toner box 40 is removed from the processing unit 20, the shutter 111 is not pivoted even when the open/close lever 113 is operated, so that the toner guiding port 88 can be kept in a blocked state. The inner casing 42 is not pivoted in the toner box 40 as described above, so that the first toner ejecting port 49 and the second toner ejecting port 55 can be kept in a state of not being communicated with each other.

As a result, with a simple configuration, the toner leakage from the toner box 40 and the processing unit 20 can be prevented.

Further, with a simple configuration in which the toner box 40 is provided with the lateral projections 54, the second radial projections 57 and the third radial projections 63, the first toner ejecting port 49 and the second toner ejecting port 55 can be communicated, the communication can be stopped, and the toner guiding port 88 can be opened and closed, as described above.

The penetration hole 112, which opens the toner guiding port 88 and allows the toner guiding port 88 to communicate with the first toner ejecting port 49, is formed on the shutter 111 at a midway in a pivotal direction thereof. In other words, unlike a notch, the penetration hole 112 is surrounded over the entire circumference, and for this reason, the toner which moves between the toner guiding port 88 and the first toner ejecting port 49 can be prevented from leaking from the penetration hole 112.

Further, the lateral projections 54, the second radial projections 57, and the third radial projections 63 are provided in the inner casing 42 at the both lateral end portions thereof, and thus the inner casing 42 and the shutter 111 can be stably pivoted while the toner box 40 is in the mounted state in the processing unit 20.

As a result, the first toner ejecting port 49 and the second toner ejecting port 55 can be communicated and the communication can be stopped, and the toner guiding port 88 can be opened and closed, stably.

Second Embodiment

In the first embodiment described above, the processing unit 20 integrally includes the drum section 27 and the developing section 30, and the processing unit 20 is removably mounted to the main body casing 2. In addition to this, in the laser printer 1 according to one or more aspects of the present invention, the drum section 27 may be removably mounted to the main body casing 2, for example, as a drum cartridge provided with the photosensitive drum 28, the scorotron charger 29, the transfer roller 31, the cleaning blush 32, and the like. Similarly, the developing section 30 may be removably mounted to the drum section 27 as a developer cartridge provided with the toner cartridge accommodation chamber 71, the developing roller 104, the feed roller 101, and the layer-thickness regulating blade 107.

In the description above, two independent embodiments of the first embodiment and the second embodiment to be applied with one or more aspects of the present invention have been described in detail. However, it should be noted that one skilled in the art may optionally combine the gist of these two embodiments and provide a processing unit, a toner box and an image forming apparatus having advantages described above in relation to the two embodiments.

The embodiments described above are illustrative and explanatory of the invention. The foregoing disclosure is not intended to be precisely followed to limit one or more aspects of the present invention. Various modifications and alterations are possible in light of the foregoing description, and may be obtained by implementing the invention. The present embodiments are selected and described for explaining the essence and practical application schemes of one or more aspects of the present invention which allow those skilled in the art to utilize one or more aspects of the present invention in various embodiments and various alterations suitable for anticipated specific use. The scope of the present invention is to be defined by the appended claims and their equivalents.

What is claimed is:

1. A processing unit detachably mountable to an image forming apparatus main body, including:

a unit main body including at least a developer carrier for feeding a developing agent to an image carrier to be formed with an electrostatic latent image; and a toner box accommodating the developing agent and detachably mountable to the unit main body, wherein the toner box includes a toner casing formed with a toner ejecting port for feeding the developing agent to the unit main body, and a toner-side blocking member for opening and closing the toner ejecting port, and the unit main body includes a process casing formed with a toner guiding port which is opposed to the toner ejecting port to receive the developing agent fed from the toner ejecting port when the toner box is mounted in the unit main body, a process-side blocking member for opening and closing the toner guiding port, and an open/close member provided on the process casing for opening and closing the toner ejecting port and the toner guiding port by the toner-side blocking member and the process-side blocking member when the toner box is mounted in the unit main body.

2. The processing unit according to claim 1, wherein the opening and closing of the toner guiding port by the process-side blocking member is performed via the opening and closing of the toner ejecting port by the toner-side blocking member.

3. The processing unit according to claim 1, wherein the toner box is detachably mountable to the unit main body in a direction orthogonal to a longitudinal direction of the developer carrier, the process-side blocking member is pivotably supported on both side walls of the process casing in a direction orthogonal to mounting and removing directions of the toner box to and from the unit main body.

4. The processing unit according to claim 3, wherein the toner-side blocking member is pivotably supported on the both side walls of the toner casing in the direction orthogonal to the mounting and removing directions of the toner box to and from the unit main body.

5. The processing unit according to claim 4, wherein the open/close member pivots the process-side blocking member by pivoting the toner-side blocking member.

6. The processing unit according to claim 5, wherein the toner box includes:

a first projection engaged with the open/close member when the toner box is in a state of being mounted in the unit main body, for opening and closing the toner ejecting port by pivoting the toner-side blocking member in accordance with a movement of the open/close member; and a second projection interlocked with the first projection, for opening and closing the toner guiding port by pivoting the process-side blocking member in accordance with the movement of the open/close member.

7. The processing unit according to claim 4, wherein the toner box is detachably mountable to the unit main body in a state where the processing unit is mounted in the image forming apparatus main body.

8. The processing unit according to claim 4, wherein the toner box includes a restricting member which restricts a pivot of the toner-side blocking member when the toner box is not mounted in the unit main body and releases the restriction on the pivot of the toner-side blocking member when the toner box is in a mounted state in the unit main body.

9. The processing unit according to claim 8, wherein the restricting member includes a toner grasp portion for gripping the toner box, the toner grasp portion is configured to change, in accordance with a gripping force applied thereof, to a first state in which the pivot of the toner-side blocking member is restricted, a second state in which the pivot of the toner-side blocking member is restricted separately from the first state, and a third state in which the restriction on the pivot of the toner-side blocking member is released midway between the first state and the second state.

10. The processing unit according to claim 9, wherein the restricting member includes a first restricting portion which restricts the pivot of the toner-side blocking member in the first state; and a second restricting portion which restricts the pivot of the toner-side blocking member in the second state.

11. The processing unit according to claim 8, wherein the restricting member includes an engaging portion which engages with the process casing in a state where the toner box is mounted in the unit main body.

12. The processing unit according to claim 4, including an engaging member for engaging the toner box with the process casing in a state where the toner box is mounted in the unit main body, and the engaging member is a toner grasp portion provided at the toner box for gripping the toner box.

13. The processing unit according to claim 3, wherein the pivot of the process-side blocking member is restricted in a state where the toner box is removed from the unit main body.

14. The processing unit according to claim 1, wherein the open/close member includes a process grasp portion configured to be gripped when the processing unit is mounted and removed to and from the image forming apparatus main body.

15. The processing unit according to claim 1, including an agitating member provided in the toner casing and the agitating member includes a shaft, and an agitating portion provided on the shaft for agitating the developing agent accommodated in the toner casing, wherein the open/close member pivots, and a pivot center of the open/close member and an axial center of the shaft substantially coincide.

16. A processing unit detachably mountable to an image forming apparatus main body including:

a unit main body including at least a developer carrier for feeding a developing agent to an image carrier formed with an electrostatic latent image, and including a process casing, and a process-side blocking member for opening and closing by pivot a toner guiding port formed in the process casing for receiving the developing agent; and a toner box accommodating the developing agent therein and detachably mountable to the unit main body, wherein the toner box includes an outer casing formed with a first toner ejecting port which is opposed to the toner guiding port when the toner box is mounted in the unit main body, and an inner casing pivotably provided with respect to the outer casing in the outer casing and formed with a second toner ejecting port, and the inner casing including a first projection engaged with an open/close member provided on the processing unit side in a state where the toner box is mounted in the unit main body, for communicating the first toner ejecting port and the second toner ejecting port with each other or for stopping the communication thereof by pivoting the inner casing in accordance with a movement of the open/close member, and a second projection interlocked with the first projection, for opening and closing the toner guiding port by pivoting the process-side blocking member in accordance with the movement of the open/close member.

17. The processing unit according to claim 16, wherein the process-side blocking member is formed with a penetration hole at a midway in a pivotal direction thereof for opening the toner guiding port to communicate with the first toner ejecting port when the process-side blocking member is pivoted by the second projection.

18. A toner box accommodating a developer agent, and detachably mountable to a unit main body included in a processing unit detachably mountable to an image forming apparatus main body, wherein the unit main body includes at least a developer carrier for feeding a developing agent to an image carrier to be formed with an electrostatic latent image, and includes a process casing, and a process-side blocking member for opening and closing by pivot a toner guiding port formed in the process casing for receiving the developing agent;

the toner box including:

a toner casing formed with a toner ejecting port which is opposed to the toner guiding port for feeding the developing agent to the unit main body when the toner box is mounted in the unit main body;

a toner-side blocking member for opening and closing the toner ejecting port by pivot;

a first projection engaged with an open/close member provided on the processing unit side when the toner box is in a state of being mounted in the unit main body, for opening and closing the toner ejecting port by pivoting the toner-side blocking member in accordance with a movement of the open/close member; and a second projection interlocked with the first projection, for opening and closing the toner guiding port by pivoting the process-side blocking member in accordance with the movement of the open/close member.

19. The toner box according to claim 18, wherein the toner box is detachably mountable to the unit main body in a direction orthogonal to a longitudinal direction of the developer carrier, and the first projection and the second projection are disposed respectively on both end portions of the toner casing in a direction orthogonal to mounting and removing directions of the toner box to and from the unit main body.

20. The toner box according to claim 18, wherein the toner box is detachably mountable to the unit main body in a state where the processing unit is mounted in the image forming apparatus main body.

21. The toner box according to claim 18, including a restricting member which restricts a pivot of the toner-side blocking member when the toner box is not mounted in the unit main body and releases the restriction on the pivot of the toner-side blocking member when the toner box is in a mounted state in the unit main body.

22. The toner box according to claim 21, wherein the restricting member includes a toner grasp portion for gripping the toner box, the toner grasp portion is configured to change, in accordance with a gripping force applied thereof, to a first state in which a pivot of the toner-side blocking member is restricted, a second state in which the pivot of the toner-side blocking member is restricted separately from the first state, and a third state in which the restriction on the pivot of the toner-side blocking member is released midway between the first state and the second state.

23. The toner box according to claim 22, wherein the restricting member includes a first restricting portion which restricts the pivot of the toner-side blocking member in the first state; and a second restricting portion which restricts the pivot of the toner-side blocking member in the second state.

24. The toner box according to claim 21, wherein the restricting member includes an engaging portion which engages with the process casing in a state where the toner box is mounted in the unit main body.

25. The toner box according to claim 18, including an engaging member for engaging the toner box with the process casing in a state where the toner box is mounted in the unit main body, and the engaging member is a toner grasp portion provided at the toner box for gripping the toner box.

26. A toner box accommodating a developer agent and detachably mountable to a unit main body included in a processing unit detachably mountable to an image forming apparatus main body, wherein the unit main body includes at least a developer carrier for feeding a developing agent to an image carrier to be formed with an electrostatic latent image, and includes a process casing, and a process-side blocking member for opening and closing by pivot a toner guiding port formed in the process casing for receiving the developing agent;

the toner box including:

an outer casing formed with a first toner ejecting port which is opposed to the toner guiding port when the toner box is mounted in the unit main body; and an inner casing pivotably provided with respect to the outer casing in the outer casing and formed with a second toner ejecting port, wherein the inner casing includes a first projection engaged with an open/close member provided on the processing unit side in a state where the toner box is mounted in the unit main body, for communicating the first toner ejecting port and the second toner ejecting port with each other or for stopping the communication thereof by pivoting the inner casing in accordance with a movement of the open/close member, and a second projection interlocked with the first projection, for opening and closing the toner guiding port by pivoting the process-side blocking member in accordance with the movement of the open/close member.

27. The toner box according to claim 26, wherein the first projection and the second projection are provided in the inner casing at both end portions in a direction of a pivot axis of the inner casing.

28. A toner box including an outer casing and an inner casing accommodated in the outer casing and freely pivotable with respect to the outer casing, and accommodating a developing agent, wherein the outer casing includes an outer round wall forming a hollow cylinder and formed with a first toner ejecting port, and a pair of outer side edge walls forming both side end surfaces of the outer round wall in a direction of a pivot axis of the inner casing, the inner casing is formed in a hollow cylinder and includes an inner round wall formed with a second toner ejecting port which communicates with the first toner ejecting port in accordance with a pivot of the inner casing, and a pair of inner side edge walls for blocking both side surfaces in a direction of a pivot axis of the inner round wall, the respective both end portions of the inner round wall in the direction of the pivot axis are provided with a pair of second radial projections and a pair of third radial projections which protrude outward in radial directions of the inner casing, each of the both end portions of the outer round wall in a direction of the pivot axis is formed with a first insertion groove allowing the second radial projection to protrude outward in the radial direction and a second insertion groove allowing the third radial projection to protrude outward in the radial direction, and the second toner ejecting port is formed between a line connecting the pair of second radial projections and a line connecting the pair of third radial projections.

29. The toner box according to claim 28, wherein each of the inner side edge walls is provided with a lateral projection protruding from the inner casing outward in the direction of the pivot axis, and each of the outer side edge walls is formed with a third insertion groove allowing each of the lateral projections to protrude outward in the direction of the pivot axis.

30. The toner box according to claim 28, wherein the inner round wall is provided with a first radial projection extending along a circumference of the second toner ejecting port and protruding outward in the radial direction.

31. The toner box according to claim 30, wherein the first radial projection is a seal member filling a space between the inner round wall and the outer round wall in the radial direction.

32. The toner box according to claim 28, wherein the outer casing includes a grasp portion on the outer round wall on the opposite side of the first toner ejecting port with respect to the pivot axis.

33. The toner box according to claim 32, wherein the outer round wall is provided with ribs on both sides of the grasp portion in the direction of the pivot axis.

34. An image forming apparatus, including:

an image forming apparatus main body; and a processing unit detachably mountable to the image forming apparatus main body, wherein the processing unit includes a unit main body including at least a developer carrier for feeding a developing agent to an image carrier to be formed with an electrostatic latent image, and a toner box accommodating the developing agent and being detachably mountable to the unit main body, the toner box includes a toner casing formed with a toner ejecting port for feeding the developing agent to the unit main body, and a toner-side blocking member for opening and closing the toner ejecting port, and the unit main body includes a process casing formed with a toner guiding port which is opposed to the toner ejecting port and receives the developing agent fed from the toner ejecting port when the toner box is mounted in the unit main body, a process-side blocking member for opening and closing the toner guiding port, and an open/close member provided at the process casing and opening and closing the toner ejecting port and the toner guiding port by the toner-side blocking member and the process-side blocking member when the toner box is mounted in the unit main body, the image forming apparatus including:

a scanning section for forming the electrostatic latent image in the processing unit; and a fixing unit for fixing on recording medium a developer image formed by developing the electrostatic latent image in the processing unit.

* * * * *